US008393721B2

(12) United States Patent
Katoh et al.

(10) Patent No.: US 8,393,721 B2
(45) Date of Patent: Mar. 12, 2013

(54) IMAGING-MATERIAL CONTAINER, INK CARTRIDGE, AND IMAGE FORMING APPARATUS

(75) Inventors: Tomomi Katoh, Ebina (JP); Tadashi Hayakawa, Yokohama (JP); Ikoh Soh, Atsugi (JP); Akiko Bannai, Atsugi (JP); Shotaro Takeuchi, Atsugi (JP); Masahiro Kuwata, Atsugi (JP); Toshiroh Tokuno, Machida (JP); Masanori Kusunoki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 302 days.

(21) Appl. No.: 12/781,023

(22) Filed: May 17, 2010

(65) Prior Publication Data

US 2010/0295908 A1 Nov. 25, 2010

(30) Foreign Application Priority Data

May 20, 2009 (JP) ..... 2009-122259

(51) Int. Cl.
*B41J 2/175* (2006.01)

(52) U.S. Cl. ..... 347/86; 347/104; 347/7

(58) Field of Classification Search ..... 347/85, 347/86, 7, 104
See application file for complete search history.

(56) References Cited

U.S. PATENT DOCUMENTS

| | | | | |
|---|---|---|---|---|
| 6,505,924 | B2 * | 1/2003 | Shimizu | 347/86 |
| 7,325,908 | B2 | 2/2008 | Katoh et al. | |
| 7,540,598 | B2 | 6/2009 | Hori et al. | |
| 2004/0130583 | A1 * | 7/2004 | Seino et al. | 347/7 |
| 2007/0195140 | A1 * | 8/2007 | Ishizawa et al. | 347/86 |
| 2008/0036828 | A1 * | 2/2008 | Koike et al. | 347/86 |
| 2009/0079804 | A1 * | 3/2009 | Kimura | 347/86 |
| 2009/0256892 | A1 | 10/2009 | Takeuchi | |
| 2009/0290002 | A1 | 11/2009 | Katoh | |
| 2010/0134574 | A1 * | 6/2010 | Kobayashi et al. | 347/85 |

FOREIGN PATENT DOCUMENTS

| | | |
|---|---|---|
| JP | 54-114956 | 8/1979 |
| JP | 2003-43797 | 2/2003 |
| JP | 2004-358838 | 12/2004 |
| JP | 2006-1123 | 1/2006 |
| JP | 2006-327111 | 12/2006 |
| JP | 2008-12698 | 1/2008 |
| JP | 2008-134591 | 6/2008 |
| JP | 2009-73096 | 4/2009 |
| WO | WO03/041964 A1 | 5/2003 |

* cited by examiner

*Primary Examiner* — Ellen Kim
(74) *Attorney, Agent, or Firm* — Cooper & Dunham LLP

(57) ABSTRACT

An imaging-material container that stores imaging material to be supplied to an image forming device includes a flexible storage member, a pressure unit, a regulation member, and a pushing unit. The flexible storage member stores imaging material. The pressure unit applies pressure on the flexible storage member. The regulation member contacts the flexible storage member to deform the flexible storage member. The pushing unit moves the regulation member as the imaging material is consumed.

16 Claims, 21 Drawing Sheets

IMAGING-MATERIAL CONTAINER, INK CARTRIDGE, AND IMAGE FORMING APPARATUS

CROSS-REFERENCE TO RELATED APPLICATIONS

The present patent application claims priority pursuant to 35 U.S.C. §119 from Japanese Patent Application No. 2009-122259, filed on May 20, 2009 in the Japan Patent Office, which is incorporated herein by reference in its entirety.

BACKGROUND OF THE INVENTION

1. Field of the Invention

Exemplary embodiments of the present disclosure relate to an imaging-material container from which imaging material is supplied to an image forming unit, and more specifically to an imaging-material container capable of reducing the residual amount of imaging material remaining therein after use, an ink cartridge including the imaging-material container, and an image forming apparatus including the ink cartridge.

2. Description of the Background

Image forming apparatuses are used as printers, facsimile machines, copiers, multi-functional peripherals having two or more of the foregoing capabilities, or plotters. As one type of image forming apparatus employing a liquid-ejection recording method, an inkjet recording apparatus is known that uses a recording head for ejecting droplets of ink.

For example, in an on-demand-type inkjet recording technique, a diaphragm is provided at a portion of a wall of a chamber containing ink and deformed by, e.g., a piezoelectric actuator to change the internal volume of the chamber to increase the pressure for ejecting ink. In one technique, a heater for generating heat by application of electricity is provided in the chamber. Heating of the heater generates bubbles to increase the pressure in the chamber, thereby ejecting ink.

With recent increases in operating speed, such inkjet-type image forming apparatuses (hereinafter also referred to as inkjet recording apparatuses) have become widespread for not only home use but also business use. Further, there is increased demand for forming an image on ultra-wide recording media. For business use, such an inkjet recording apparatus is provided with an ink cartridge capable of storing a large volume of ink, to reduce the frequency of cartridge replacement.

Accordingly, instead of a system in which the ink cartridge is directly mounted on the recording head, such inkjet recording apparatuses may employ a system in which the ink cartridge (also referred to as a main tank or main cartridge) is removably mounted in the image forming apparatus and connected to the recording head mounted on, e.g., a carriage via a tube to supply ink, an arrangement that is also referred to as a tube supply system.

With the tube supply system, ink consumed for image formation is supplied from the ink cartridge to the recording head via the tube. However, this system is not without its problems. For example, using a flexible thin tube may cause substantial fluid resistance for ink passing through the tube and prevent ink from being supplied on time for ink ejection, resulting in ejection failure. In particular, a large-size image forming apparatus that forms an image on a large-width recording medium necessarily uses a relatively long tube, resulting in increased fluid resistance of the tube.

Further, high-speed recording or ejection of high-viscosity ink may increase the fluid resistance of the tube, causing ink supply shortage in the recording head.

Hence, for example, in one conventional technique like that described in JP-3606282-B, ink is kept at a pressurized state in the ink cartridge and a differential-pressure regulating valve is disposed upstream of the recording head in the ink supply direction to supply ink when negative pressure in the sub tank (head tank) exceeds a threshold level.

Such a configuration may prevent the above-described ink supply (refill) shortage from occurring. However, when the pressurization method is implemented in a system in which ink is stored in an ink pack made of flexible material to secure the storage stability of ink, the ink pack may not properly deform as the volume of ink in the ink pack decreases, thus preventing the ink from being fully used.

To deal with such a failure, for example, a conventional technique like that described in JP-2006-001123-A proposes that a pump be provided at an ink output portion of the ink pack to suction ink from the ink pack. However, this technique requires a complex pump system to be provided in the ink cartridge and a driving unit for driving the pump to be provided in the image forming apparatus, increasing the cost of both the ink cartridge and the image forming apparatus.

The same situation occurs in a toner supply system of an image forming apparatus using an electrophotographic technique. For example, a technique like that described in JP-2008-134391-A proposes that air pressure to a container storing toner be used to move toner to a toner output port, thereby reducing the residual amount of toner remaining in the container. Although generally successful, there is room for improvement in this approach in terms of fully and reliably compressing the container storing toner.

SUMMARY OF THE INVENTION

In an exemplary embodiment, an imaging-material container that stores imaging material to be supplied to an image forming device includes a flexible storage member, a pressure unit, a regulation member, and a pushing unit. The flexible storage member stores imaging material. The pressure unit applies pressure on the flexible storage member. The regulation member contacts the flexible storage member to deform the flexible storage member. The pushing unit moves the regulation member as the imaging material is consumed.

In another exemplary embodiment, an imaging-material container that stores imaging material to be supplied to an image forming device includes a deformable storage member, an imaging-material supply portion, and a plurality of plate members. The deformable storage member includes at least two opposing sidewalls. The imaging-material supply portion is mounted in the storage member to receive an introduction member disposed in the image forming device. A plurality of plate members is mounted on outer surfaces of the at least two opposing sidewalls of the storage member. The plurality of plate members is folded around an end portion of the plurality of plate members disposed opposite the imaging-material supply portion.

In still another exemplary embodiment, an imaging-material container that stores imaging material to be supplied to an image forming device includes a deformable storage member, an imaging-material supply portion, a plate member, and an outer case member. The deformable storage member includes at least two opposing sidewalls. The imaging-material supply portion is mounted in the storage member to receive an introduction member disposed in the image forming device. The plate member is mounted on an outer surface of one of the at least two opposing sidewalls of the storage member. The outer case member houses the storage member and the plate member. The plate member is folded against an inner wall surface of the outer case member around an end portion of the plate member disposed opposite the imaging-material supply portion.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1A:
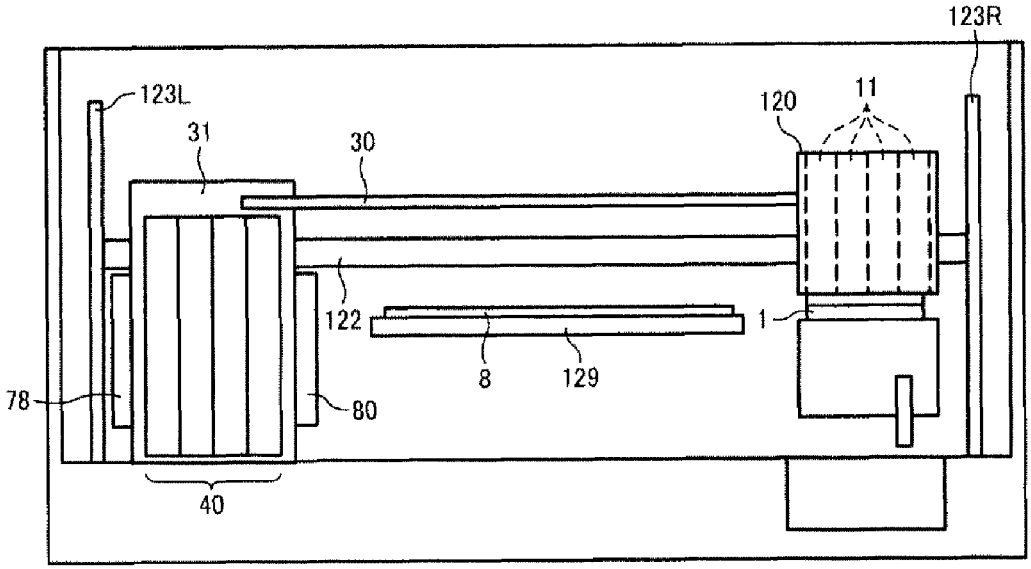
FIGS. 1A to 1C are schematic views illustrating a configuration of an inkjet printer as an example of an image forming apparatus according to a first exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation" used herein includes providing not only meaningful images such as characters and figures but meaningless images such as patterns to the medium. The term "ink" used herein is not limited to "ink" in a narrow sense and includes anything useable for image formation, such as a DNA sample, resist, pattern material, washing fluid, storing solution, and fixing solution. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, or a recording sheet.

Although the exemplary embodiments are described with technical limitations with reference to the attached drawings, such description is not intended to limit the scope of the present invention and all of the components or elements described in the exemplary embodiments of this disclosure are not necessarily indispensable to the present invention.

Below, exemplary embodiments according to the present disclosure are described with reference to attached drawings.

Figure 1B:
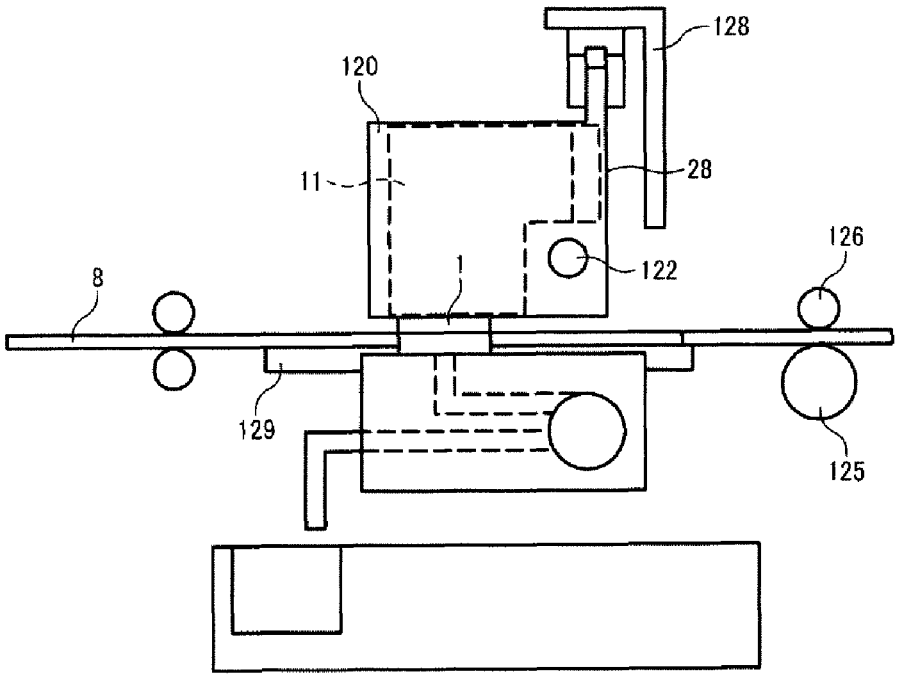
Figure 1C:
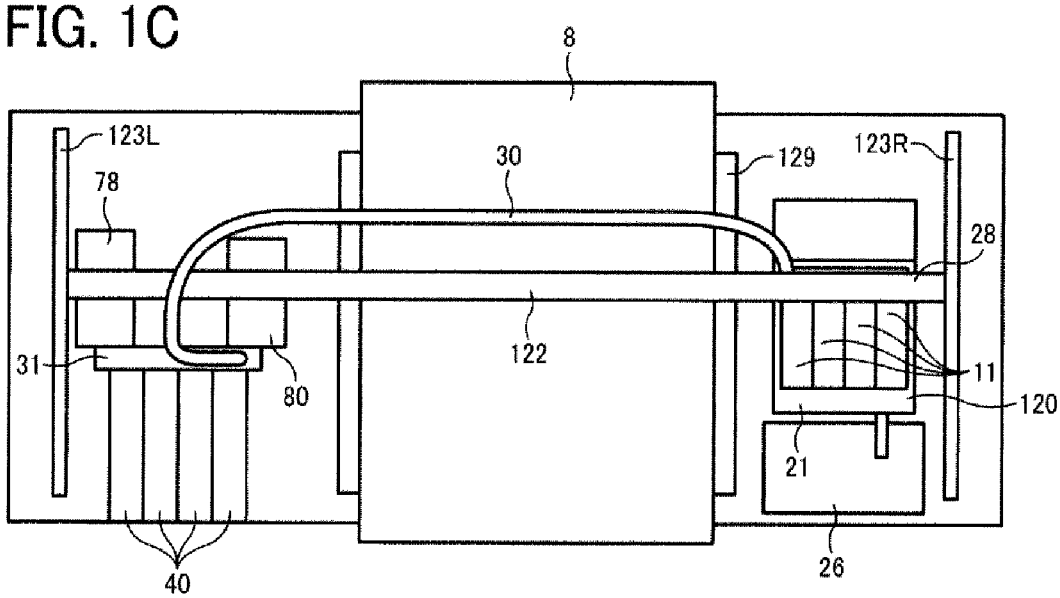

FIGS. 1A to 1C are schematic views illustrating a configuration of an inkjet printer as an example of an image forming apparatus according to a first exemplary embodiment of the present disclosure.

In the inkjet printer, a carriage 120 is slidably held by both a guide rod 122 and a guide rail 128 that are guide members extending between side plates 123L and 123R. The carriage 120 moves for scanning in a main scan direction (i.e., a long direction of the guide rod 122) by a main scan motor, not illustrated, via a timing belt.

On the carriage 120 is mounted a recording head 1 to eject ink droplets of different colors, e.g., yellow (Y), cyan (C), magenta (M), and black (Bk). The recording head 1 is provided with a plurality of ink ejection orifices arranged in a direction (sub-scan direction) perpendicular to the main scan direction so as to eject ink droplets downward.

Figure 2:
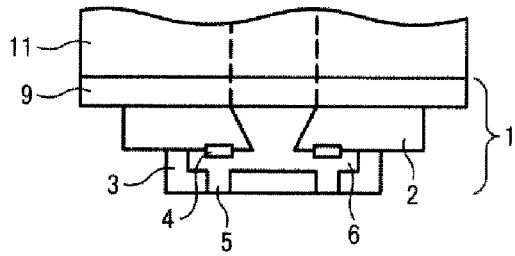
FIG. 2 is a schematic view illustrating a configuration of a recording head.

As illustrated in FIG. 2, the recording head 1 includes a heater substrate 2 and a chamber formation member 3 and ejects ink supplied from a channel formed in a head-base member 9. In FIG. 2, the recording head 1 is a thermal-type recording head in which driving a heater 4 causes film boiling of ink to generate ejection pressure and which employs a side-shooter method, in which a flow direction of ink toward an ejection-energy acting portion (the heater 4) in the chamber 6 is perpendicular to an opening central axis of nozzles 5.

It is to be noted that the recording head may be, e.g., a piezoelectric type, in which a diaphragm is deformed with a piezoelectric element to generate ejection pressure, or an electrostatic type, in which a diaphragm is deformed with electrostatic force to generate ejection pressure. In short, any suitable type may be used in the mage forming apparatus according to the present exemplary embodiment.

A sheet 8 on which an image is to be formed by the recording head 1 is conveyed in the sub-scan direction perpendicular to the main scan direction and positioned below the carriage 120. As illustrated in FIG. 1B, the sheet 8 is sandwiched with a conveyance roller 125 and a press roller 126 and conveyed to an image formation area (print area). When the sheet 8 is conveyed onto a print guide member 13, the scanning of the carriage 120 in the main scan direction is synchronized with the ejection of ink droplets from the recording head 1 at a proper timing in accordance with image data to form one band of an image on the sheet 8. After the formation of the one band of the image, the sheet 8 is fed by a certain amount in the sub scan direction to perform the above-described recording operation. The recording operation is repeatedly performed until one page of the image is formed.

In FIGS. 1A and 1C, head tanks 11 (also "buffer tanks" or "sub tanks") each including an ink chamber 16 that temporarily stores ink to be ejected are integrally connected to an upper portion of the recording head 1. The term "integrally" used herein means that the recording head 1 is connected to the head tanks 11 via tubes or pipes and both the recording head 1 and the head tanks 11 are mounted on the carriage 120.

Figure 3A:
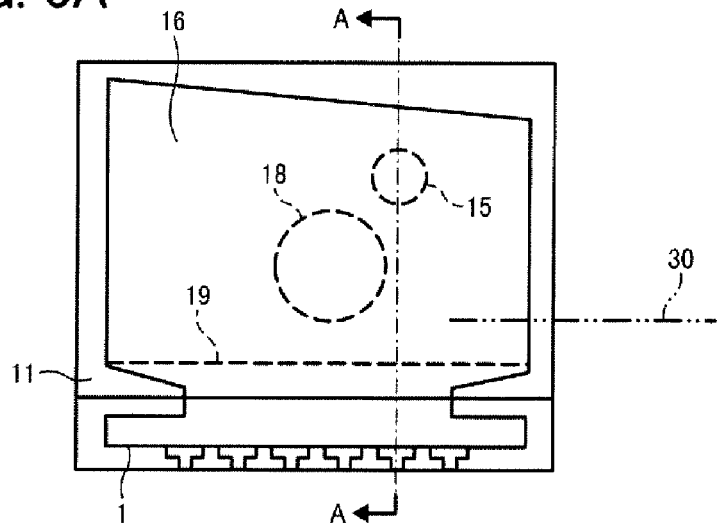
FIGS. 3A to 3C are schematic views illustrating a configuration of a head tank.
Figure 3B:
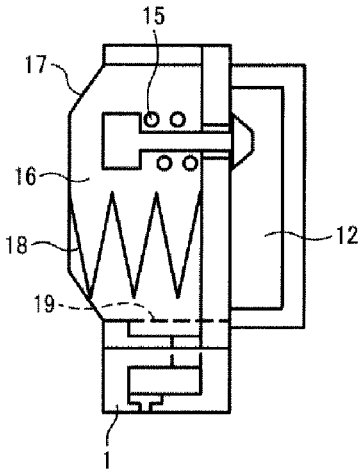
Figure 3C:
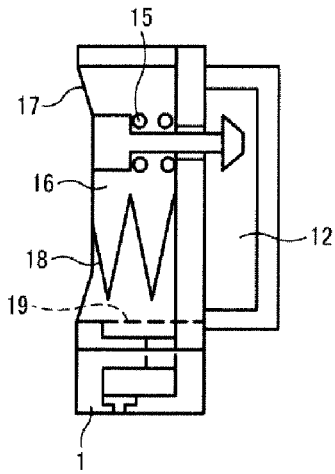

FIGS. 3A to 3B are schematic views illustrating a configuration of the head tank 11. FIG. 3A is a front view illustrating the head tank 11. FIGS. 3B and 3C are cross-sectional views illustrating the head tank 11 cut along a A-A line illustrated in FIG. 3A. It is to be noted that, for simplicity or easier understanding, several components are omitted from FIGS. 3A to 3C and cross sections of several components are only partially illustrated.

As illustrated in FIG. 3B, the head tank 11 includes two chambers: the ink chamber 16 and a pressurized chamber 12. In the ink chamber 16, a filter 19 is disposed near a connecting portion connected to the recording head 1. After dust and foreign materials are removed from ink with the filter 19, ink is supplied to the recording head 1.

A film member 17 is provided at a wall surface of the head tank 11 and biased by a spring 18 in a direction of increasing the volume of the head tank 11. Thus, as illustrated in FIG. 3B, the film member 17 is inflated in convex shape toward the exterior of the head tank 11. A negative-pressure valve 15 serving as a supply valve is disposed adjacent to the film member 17. The negative-pressure valve 15 is a valve that controls the state of communication (and non-communication) between the ink chamber 16 and the pressurized chamber 12. Normally, the negative-pressure valve 15 maintains a non-communication state as illustrated in FIG. 3B. By contrast, as illustrated in FIG. 3C, consumption of ink stored in the ink chamber 16 causes the film member 17 to shift toward the interior of the ink chamber 16. The pressurized chamber 12 of the head tank 11 is connected to a connection member 28 illustrated in FIGS. 1A and 1B and communicated with one end of a liquid supply tube 30. The other end of the liquid supply tube 30 is communicated with a cartridge holder 31. Through the liquid supply tube 30, ink of an ink cartridge 40 mounted in the cartridge holder 31 is supplied to the pressurized chamber 12 of the head tank 11.

Figure 4:
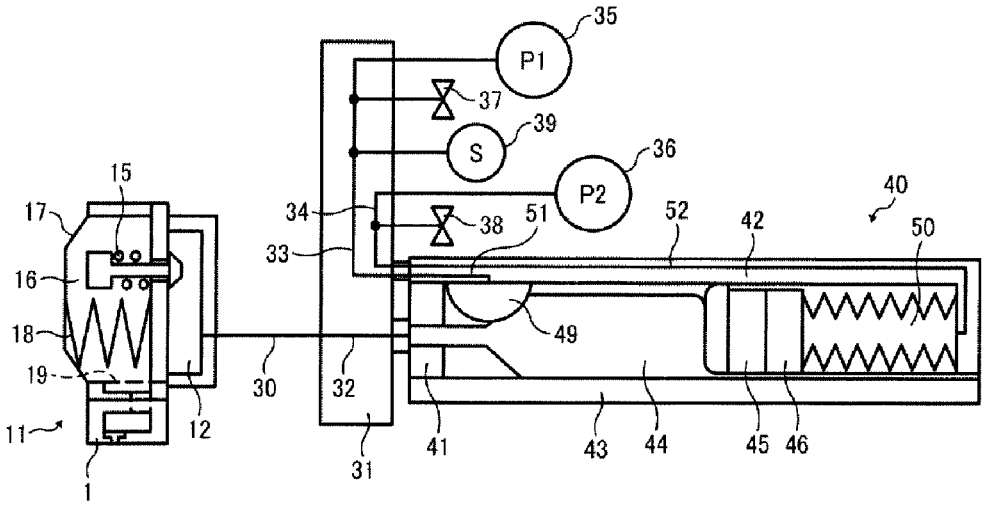
FIG. 4 is a schematic view illustrating a mechanism of supplying ink to the recording head.

FIG. 4 is a schematic view illustrating a mechanism of supplying ink to the recording head 1. As illustrated in FIG. 4, the ink cartridge 40 includes an ink pack 44, a first deformation portion 49, a second deformation portion 50, a squeezer 45, and a slider 46. The first deformation portion 49 and the second deformation portion 50 are deformable by air flowing in and out via air tube passages 51 and 52 in a case 42 and formed of an elastic member of flexible material such as rubber or a deformable member having, e.g., an accordion shape. Air is pumped into and out of the first deformation portion 49 and the second deformation portion 50 by pumps 35 and 36 connected via air passages 33 and 34 of the cartridge holder 31. The air passages 33 and 34 are connected to air release valves 37 and 38 that open the interior of the air passages 33 and 34 to the atmosphere. The air passages 33 and 34 are also connected to a pressure sensor 39 that determines the internal pressure.

Next, the configuration of the ink cartridge 40 is further described with reference to FIGS. 5A to 5C.

Figure 5A:
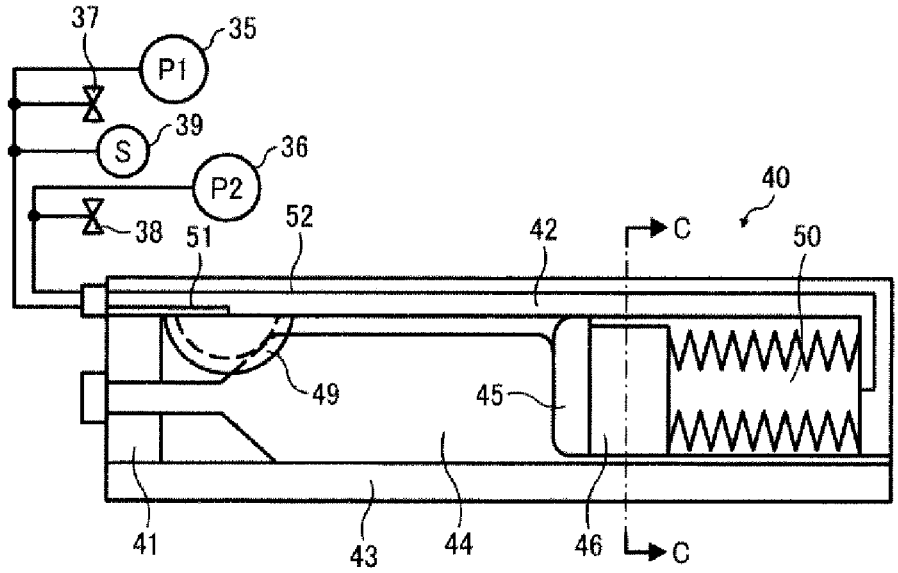
FIG. 5A is a cross-sectional view illustrating the interior of an ink cartridge.
Figure 5B:
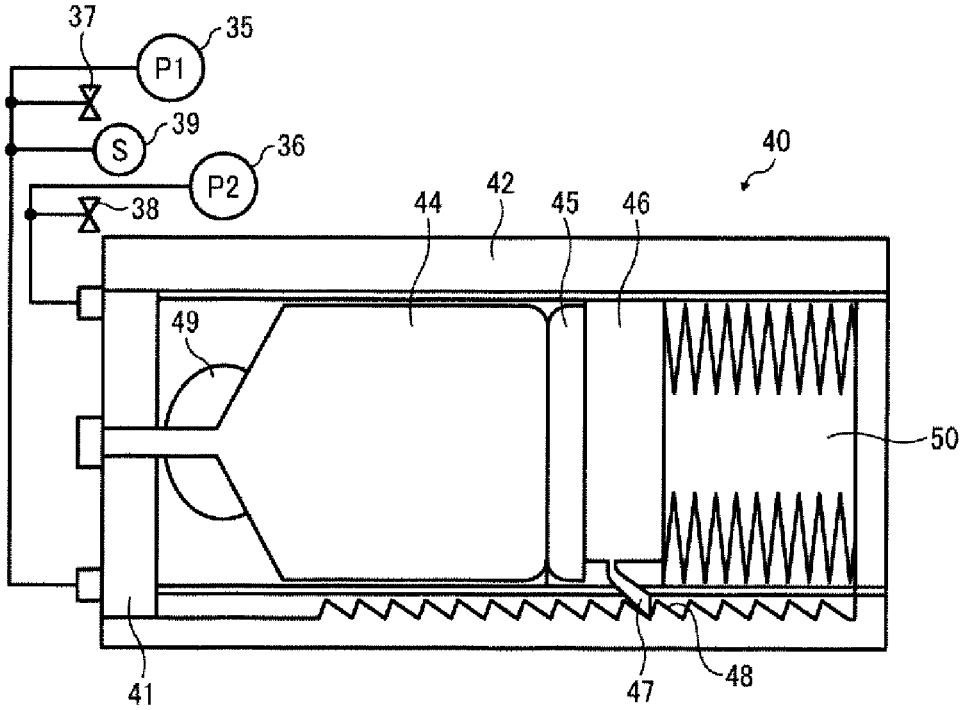
FIG. 5B is a plan view illustrating a state in which a cover is removed from the ink cartridge.
Figure 5C:
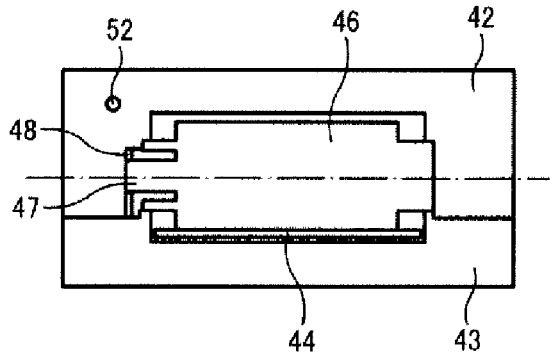
FIG. 5C is a cross-sectional view illustrating the ink cartridge cut along a line C-C illustrated in FIG. 5A.

FIG. 5A is a cross-sectional view illustrating the ink cartridge 40. FIG. 5B is a plan view illustrating a state in which a cover 43 is removed from the ink cartridge 40. FIG. 5C is a cross-sectional view illustrating the ink cartridge 40 cut along a line C-C illustrated in FIG. 5A.

One end portion of the ink pack 44 is fixed at a spout 41 and fixedly accommodated in a container formed of the case 42 and the cover 43 via the spout 41. The other end portion of the ink pack 44 opposite the spout 41 is provided the squeezer 45 that presses a portion of the ink pack 44 so as to squeeze ink out toward the spout 41.

The squeezer 45 is fixed at the slider 46 that slides while being guided along the case 42. When the second deformation portion 50 is deformed by the second pump 36, the squeezer 45 slides toward the spout 41 from a bottom side of the ink cartridge 40, i.e., a side opposite the spout 41. The squeezer 45 moves while squeezing the ink pack 44, and accordingly, ink is collected to the side of the ink pack 44 proximal to the spout 41 with respect to the squeezer 45 and little ink remains in the bottom portion of the ink pack 44.

Figure 6:
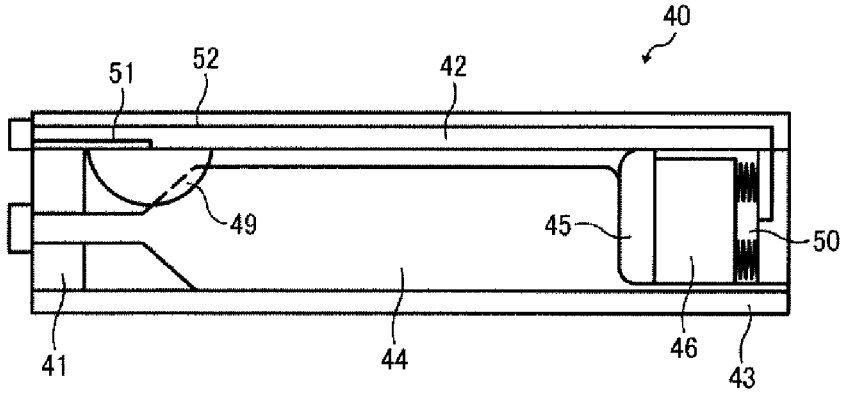
FIG. 6 is a cross-sectional view illustrating a state in which ink of the ink cartridge is not in use.

FIG. 6 is a cross-sectional view illustrating a state in which ink of the ink cartridge 40 is not in use.

At this state, the squeezer 45 is positioned at the bottom side of the ink cartridge 40 and a large amount of ink is contained in the side of the ink pack 44 proximal to the spout 41. As ink is consumed, the second deformation portion 50 deforms to press the slider 46 and the squeezer 45. Thus, the slider 46 and the squeezer 45 pushes ink toward the spout 41 while deforming the ink pack 44 so that ink does not remain in the bottom side of the ink pack 44.

Figure 7:
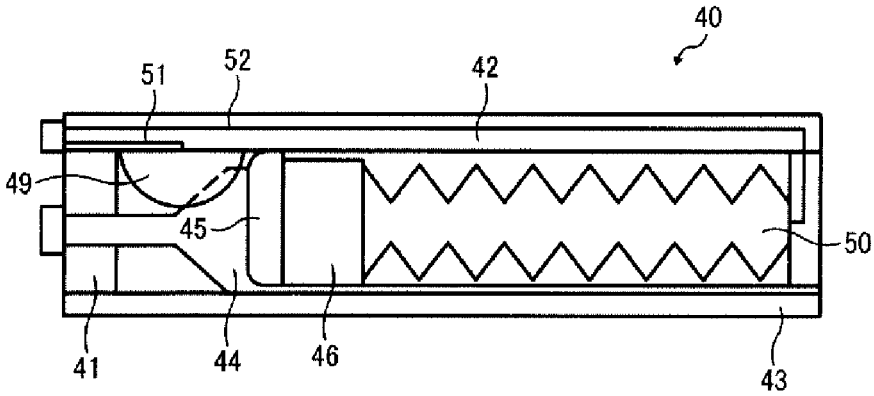
FIG. 7 is a schematic view illustrating a state in which an ink pack of the ink cartridge is out of ink.
Figure 8:
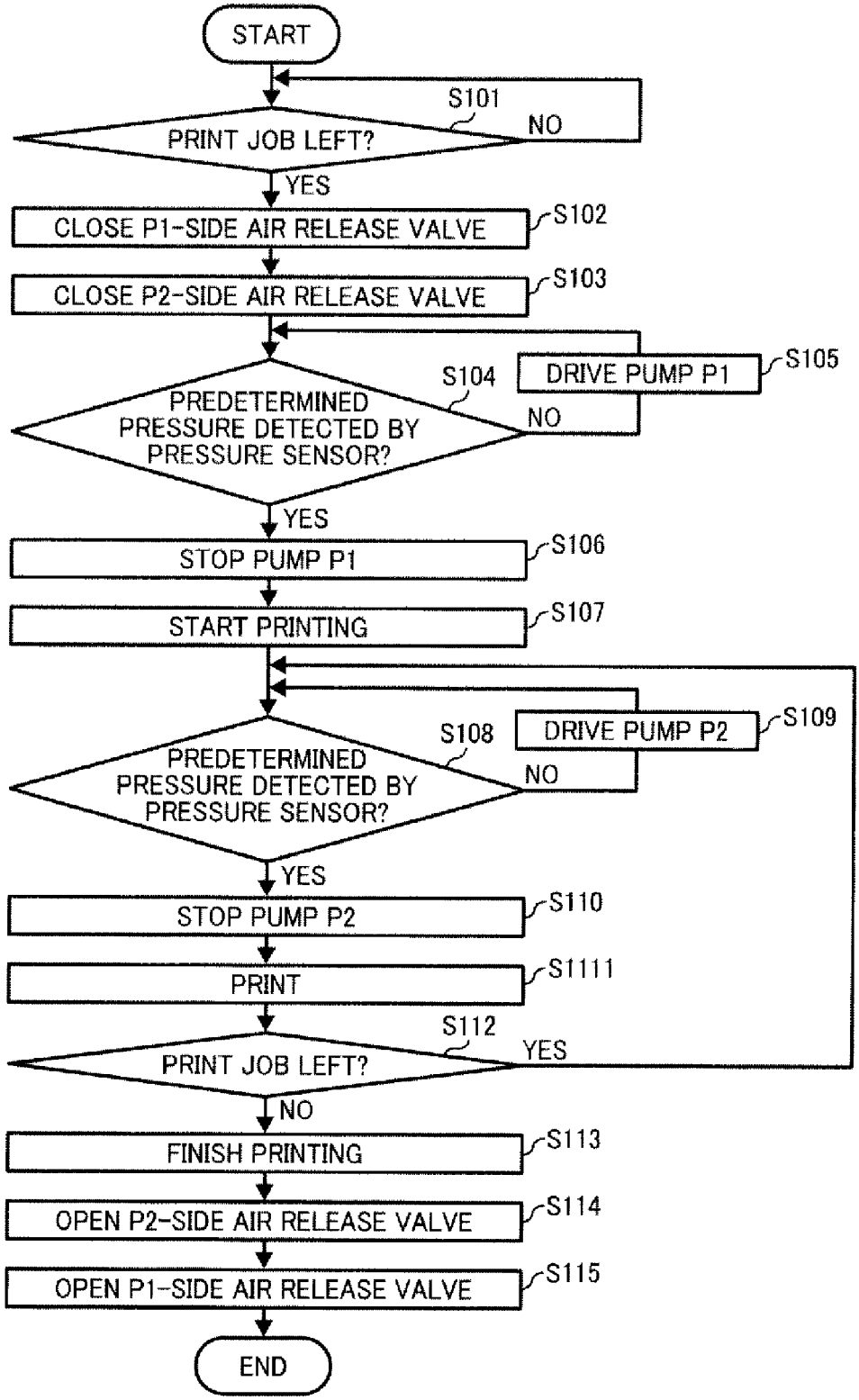
FIG. 8 is a flow chart illustrating steps in a process of supplying ink from the ink cartridge.
Figure 9A:
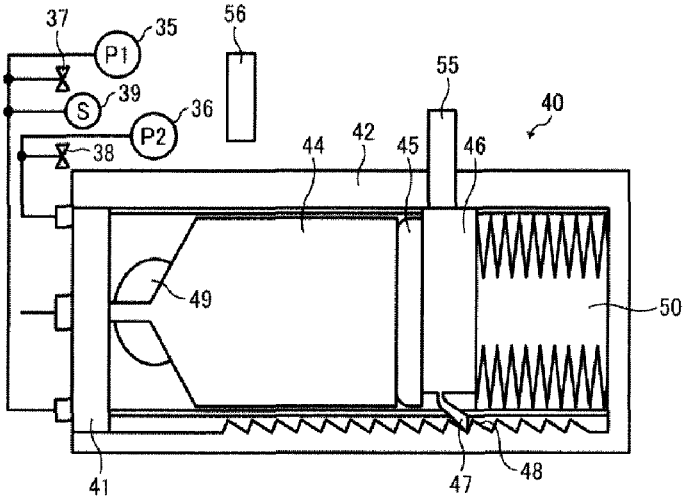
FIGS. 9A and 9B are schematic views illustrating a configuration of the ink cartridge with a sensor that detects an ink end state.
Figure 9B:
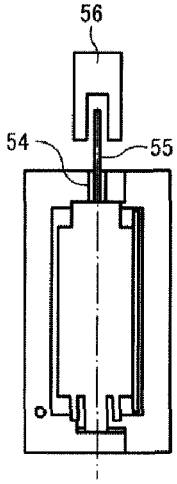

FIG. 7 is a schematic view illustrating a state in which the ink cartridge 40 is out of ink after ink is consumed.

In the ink cartridge 40, ink is squeezed out by continuously compressing the ink pack 44 with the squeezer 45. As a result, a portion of the ink pack 44 closer to the bottom side than the squeezer 45 is flattened, thus reducing the amount of residual ink left over in the ink pack 44. If the squeezing of the ink pack 44 by the squeezer 45 is insufficient, ink may move to the bottom side of the ink pack 44, resulting in an increased amount of residual ink at the ink end state. In such a case, as illustrated in FIG. 6, the second deformation portion 50 may be contracted to return the slider 46 to the bottom side of the ink pack 44 and then extended to squeeze the ink pack 44 again. However, in such a case, if the ink pack 44 is repeatedly rubbed by the squeezer 45, the ink pack 44 might be damaged and possibly leak ink.

Hence, in the present exemplary embodiment, the squeezer 45 is made of an elastic material such as rubber or elastomer to secure close contact between the squeezer 45 and the ink pack 94. As illustrated in FIG. 5B, a beam portion 47 is formed on the slider 46 holding the squeezer 45 to engage with a saw-teeth-shaped guide portion 48 of the case 42. With such a configuration, when the slider 46 is pushed by the second deformation portion 50, the beam portion 47 is bent to move toward the spout 41 over projections and depressions of the saw-teeth-shaped guide portion 48. When the slider 46 is not pushed by the second deformation portion 50, the internal pressure of the ink pack 44 causes a force to push back the squeezer 45 and the slider 46 toward the bottom side of the ink pack 44. However, the beam portion 47 engages with the saw-teeth-shaped guide portion 48 and accordingly the squeezer 45 and the slider 46 stop at a position at which the beam portion 47 engages with the saw-teeth-shaped guide portion 48. With such a configuration, the ink pack 44 is squeezed with the squeezer 45 only once, preventing damage to the ink pack 44 and facilitating reuse of the ink pack 44.

Next, ink supply operation of the ink cartridge 40 is described with reference to FIGS. 5A to 5C and 6 to 8.

When the inkjet printer is stopped or waiting for a print signal, the pumps 35 and 36 are stopped and the air release valves 37 and 38 are opened. The air-tube passages 51 and 52, the first deformation portion 49, and the second deformation portion 50 are communicated with the atmosphere. When the inkjet printer receives a print job ("YES" at S101), the air release valve 37 and the second air-release valve 38 are closed, and as a result, the air-tube passages 51 and 52 and the deformation portions 49 and 50 are closed off from the atmosphere (at S102 and S103). At S104, the pressure detected by the pressure sensor 39 is confirmed. At this time, initially atmospheric pressure is detected.

At S105, the first pump 35 is driven to pump air from the exterior into the first deformation portion 49 through the first air-tube passage 51. Thus, the first deformation portion 49 inflates from the state indicated by a dotted line to the state indicated by a solid line illustrated in FIG. 5A and increases the internal pressure. When the internal pressure reaches a predetermined target pressure value ("YES" at S104), at S106 the first pump 35 is stopped. The target pressure value varies depending on various conditions, such as ejection speed, ink viscosity, length or internal diameter of the ink supply tube. For example, if the length of the ink supply tube is 1 to 2 m and the internal diameter is approximately 2 mm, 40 to 50 kPa, the target pressure value is 40 to 50 kPa. As described above, by inflating the first deformation portion 49 to press the ink pack 44, ink in the ink pack 44 is also pressed.

At this state, print operation is started (S107). Ink to be ejected from the recording head 1 is supplied from the head tank 11 illustrated in FIGS. 3A to 3C and 4. As the amount of ink decreases in the ink chamber 16 of the head tank 11, the negative-pressure valve 15 opens as illustrated in FIG. 3C, causing the ink chamber 16 to be communicated with the pressurized chamber 12. As illustrated in FIG. 4, ink in the pressurized chamber 12 is communicated with the ink pack 44 pressurized, and accordingly ink is promptly replenished from the ink cartridge 40 to the head tank 11. As the internal pressure of the ink chamber 16 exceeds a predetermined pressure by the replenishment of ink, the negative-pressure valve 15 is closed as illustrated in FIG. 3B, thus causing the ink chamber 16 to be hermetically sealed.

Thus, printing is performed while alternately repeating the states illustrated in FIGS. 3B and 3C to maintain the internal pressure of the ink chamber 16 substantially constant. At this time, ink in the ink cartridge 40 is pressurized with a predetermined pressure. Accordingly, even when the recording head 1 consumes ink rapidly or the ink supply passage has a high fluid resistance due to use of a long tube, such a configuration allows stable ink supply while preventing ink supply shortage.

As the amount of ink decreases in the ink pack 44 by printing, the pressure applied to ink decreases. For the ink cartridge 40 illustrated in FIGS. 5A to 5C, contraction of the ink pack 44 reduces the pushing force of the ink pack 44 against the first deformation portion 49. Thus, the reduction in the ink pressure can be detected with the pressure sensor 39 ("NO" at S108). The second pump 36 is driven to pump air into the second deformation portion 50 via the air passage 34 (S109). As a result, the second deformation portion 50 is inflated to move the slider 46. Accordingly, the squeezer 45 presses the ink pack 44 while squeezing ink out of the ink pack 44. As a result, the pressure value of ink in the ink pack 44 returns to its original pressure value. Such returning to the original pressure value of ink can be detected with the pressure sensor 39, and accordingly at the time of detection, the second pump 36 is stopped (S110).

Thus, while maintaining the pressure of ink in the ink pack 44 in a certain range of pressure values, the second deformation portion 50 is inflated to supply ink to the recording head 1, allowing sequential printing to be performed (S111). When no print job remains ("NO" at S112) and printing is finished (S113), the second air-release valve 38 and the first air release valve 37 are opened at S114 and S115, respectively. As a result, the interior of both the first deformation portion 49 and the second deformation portion 50 is opened to the atmosphere to release the pressure. Thus, the pressurized state of ink in the ink pack 44 and the pressurized chamber 12 of the head tank 11 is released, thus preventing ink from slowly leaking out even if the sealing performance of the negative-pressure valve 15 of the head tank 11 is insufficient. Further, for example, when the ink cartridge 40 is removed from the cartridge holder 31, the above-described configuration can securely prevent ink from leaking from the connection portion between the ink cartridge 40 and the cartridge holder 31.

In the ink cartridge 40 according to the present exemplary embodiment, as ink is consumed by printing, the ink pack 44 is compressed from an end portion (bottom side) of the ink pack 44. When the ink pack 44 is out of ink, the ink pack 44 is at a state illustrated in FIG. 7. At this state, even if air is pumped into the second deformation portion 50 with the second pump 36, the second deformation portion 50 is not inflated and consequently the first deformation portion 49 is not pressed by the ink pack 44. As a result, the internal pressure of the first deformation portion 49 monitored with the pressure sensor 39 does not return from a reduced state due to ink consumption to a proper range, thus allowing the pressure sensor 39 to detect that the ink pack 44 is out of ink.

Figure 10A:
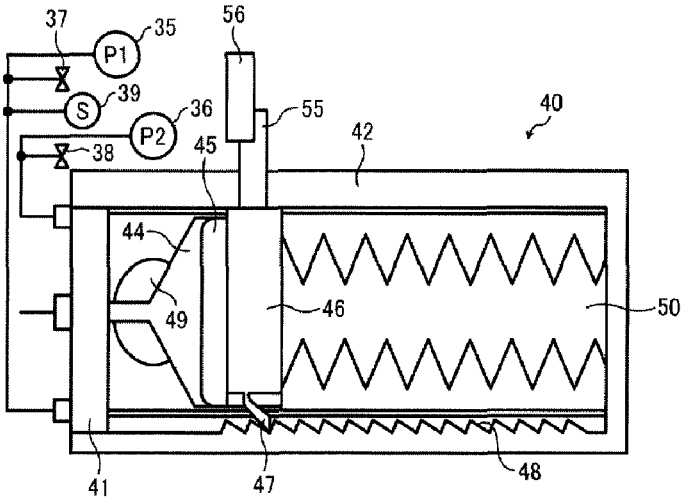
FIGS. 10A and 10B are schematic views illustrating a state in which the ink end state is detected by the sensor.
Figure 10B:
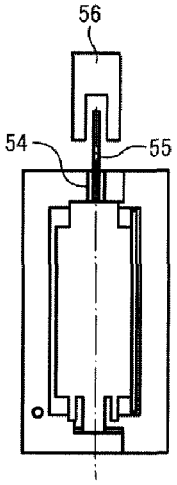

In another method of detecting the ink-end state, for example, as illustrated in FIGS. 9A, 9B, 10A, and 10B, a slit formed in the case 42 of the ink cartridge 40. Further, a detection board 55 is mounted on the slider 46 and a sensor 56, e.g., a photosensor provided outside the ink cartridge 40, thus allowing the ink-end state to be precisely detected as illustrated in FIGS. 10A and 10B.

In the above-described configuration, the ink pack 44 is squeezed with the squeezer 45 formed of an elastic member fixed at the slider 46. However, it is to be noted that the method of squeezing the ink pack 44 is not limited to the above-described configuration.

Figure 11:
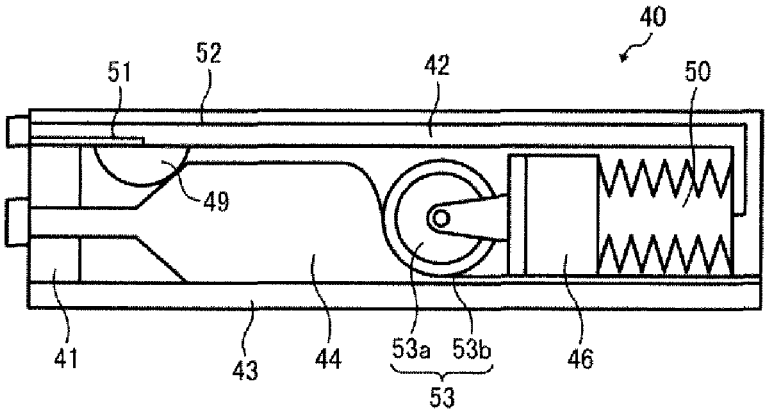
FIG. 11 is a schematic view illustrating another configuration of the ink cartridge using a squeeze roller.

FIG. 11 is a schematic view illustrating another configuration of the ink cartridge 40 using a squeeze roller 53.

The squeeze roller 53 includes a roller member 53*a* made of resin or metal and an elastic layer 53*b* formed on the surface of the roller member 53*a*. The second deformation portion 50 moves the squeeze roller 53 while pressing the squeeze roller 53 against the ink pack 44, allowing ink to be effectively squeezed out of the ink pack 44. With this configuration, the squeeze roller 53 moves while rolling over the surface of the ink pack 44. Accordingly, compared to the configuration illustrated in FIGS. 5A to 5C in which the squeezer 45 moves while rubbing the surface of the ink pack 44, such a configuration can reduce damage to the ink pack 44, thus improving recycling of the ink pack 44.

As described above, in the present exemplary embodiment, the ink cartridge that supplies ink by applying pressure on the ink pack is provided with a mechanism for compressing the ink pack in one direction from one end of the ink pack and two types of pressure sources to apply pressure on the ink pack. Such a configuration allows ink to be supplied at high speed in printing, securely prevents ink from leaking in non-driving periods, and reduces the amount of residual ink remaining in the ink pack at the ink-end state. Further, with such a configuration, pressure is applied on the ink pack by using the pressure of fluid, allowing ink to be pressed in a simple configuration.

A second exemplary embodiment of the present disclosure is described with reference to drawings.

An inkjet printer according to the present exemplary embodiment has a substantially same configuration as the first exemplary embodiment except for the configuration of the ink cartridge.

Figure 12:
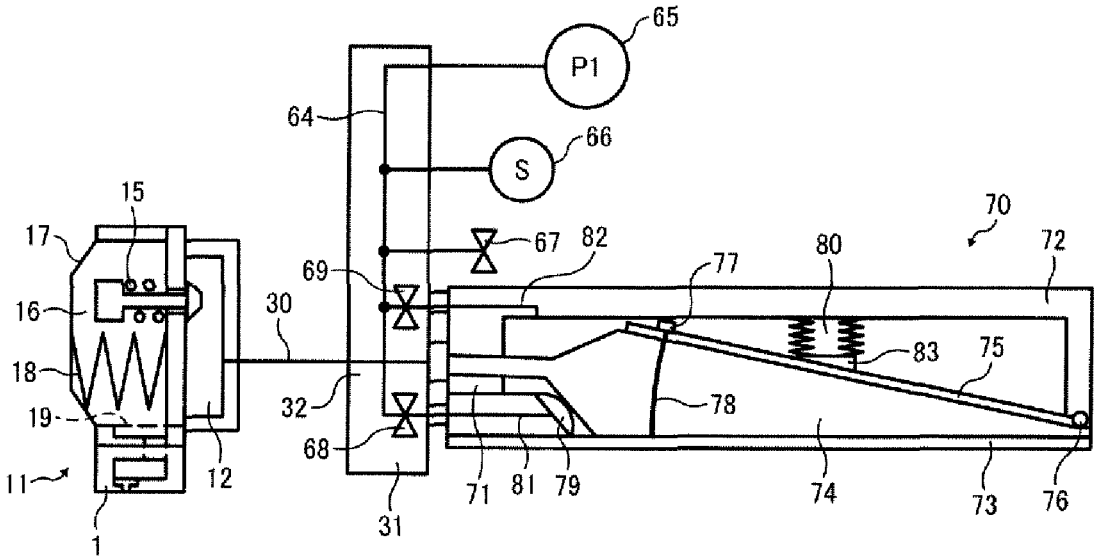
FIG. 12 is a schematic view illustrating a configuration of an ink cartridge according to a second exemplary embodiment.

FIG. 12 is a schematic view illustrating a configuration of an ink cartridge employed in an inkjet printer according to the present exemplary embodiment.

The ink cartridge 70 includes an ink pack 74, a first deformation portion 79, a second deformation portion 80, and a pressure plate 75. The first deformation portion 79 and the second deformation portion 80 are deformable by air flowing into and out of the exterior via air-tube passages 81 and 82 and formed of an elastic member of a flexible material such as rubber and a deformable member having, e.g., an accordion shape. Air is flown into and out of the first deformation portion 79 and the second deformation portion 80 using a pressure pump 65 and valves 68 and 69 that are connected via an air passage 64 of the cartridge holder 31. To the air passage 64 are connected an air release valve 67 that opens the interior of the air passage 64 to the atmosphere and a pressure sensor 66 that determines an internal pressure.

Figure 13:
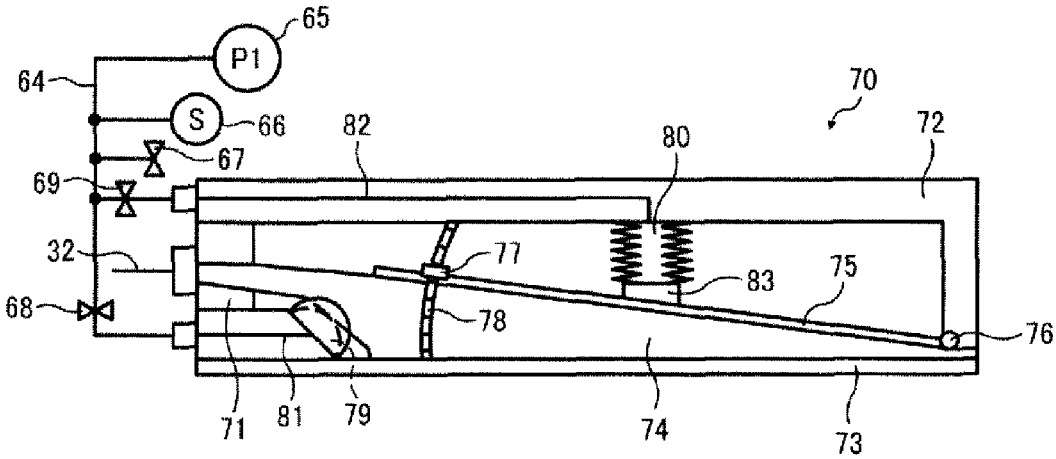
FIG. 13 is a schematic view illustrating the ink cartridge illustrated in FIG. 12.

Next, the configuration of the ink cartridge 70 is further described with reference to FIG. 13.

The ink pack 74 is fixed at a spout 71 at its one end and fixedly accommodated in a container formed of a case 72 and a cover 73. The pressure plate 75 is disposed in contact with one surface of the ink pack 74, and the pressure plate 75 pivots around a pivot shaft 76 at the bottom side of the case 72 opposite the spout 71.

The pressure plate 75 is provided with the second deformation portion 80 via a pressing member 83 at a side opposite the ink pack 74. Inflation and extension of the second deformation portion 80 cause the pressure plate 75 to compress the ink pack 74. The pressure plate 75 is also provided with a beam holder 77. The beam holder 77 moves while being guided by a guide member 78 of the case 72.

Figure 14:
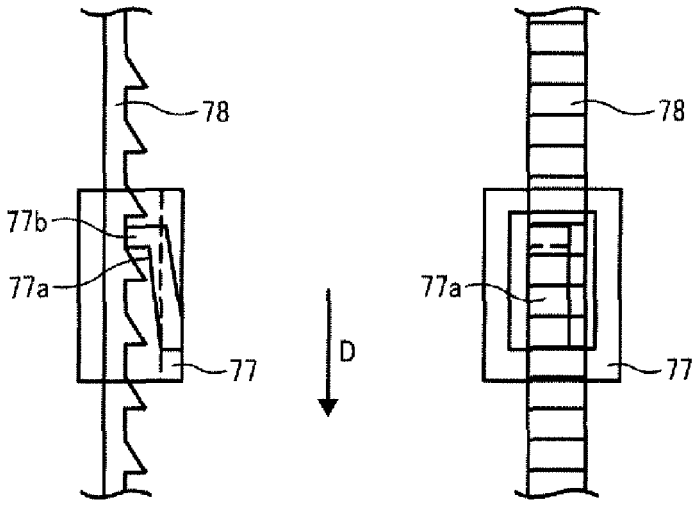
FIG. 14 is a schematic view illustrating a beam holder and a guide member.

An example of the configuration of the beam holder 77 and the guide member 78 with reference to FIG. 14.

The guide member 78 has a cross section of substantially saw teeth shape in the long direction thereof. The beam holder 77 has a beam 77*a* that is flexibly bendable and contacts a saw-teeth portion of the guide member 78. Accordingly, the beam holder 77 is movable in a direction indicated by an arrow "D" illustrated in FIG. 14 and immovable in a direction opposite the direction "D". In other words, the pressure plate 75 is movable only in a direction to compress the ink pack 74. The first deformation portion 79 is disposed at a position not contacting with the pressure plate 75 near the spout 71 to press the ink pack 74. As with the second deformation portion 80, the first deformation portion 79 is extended and contracted by the driving of the pressure pump 65 that is disposed at the printer side.

Figure 15:
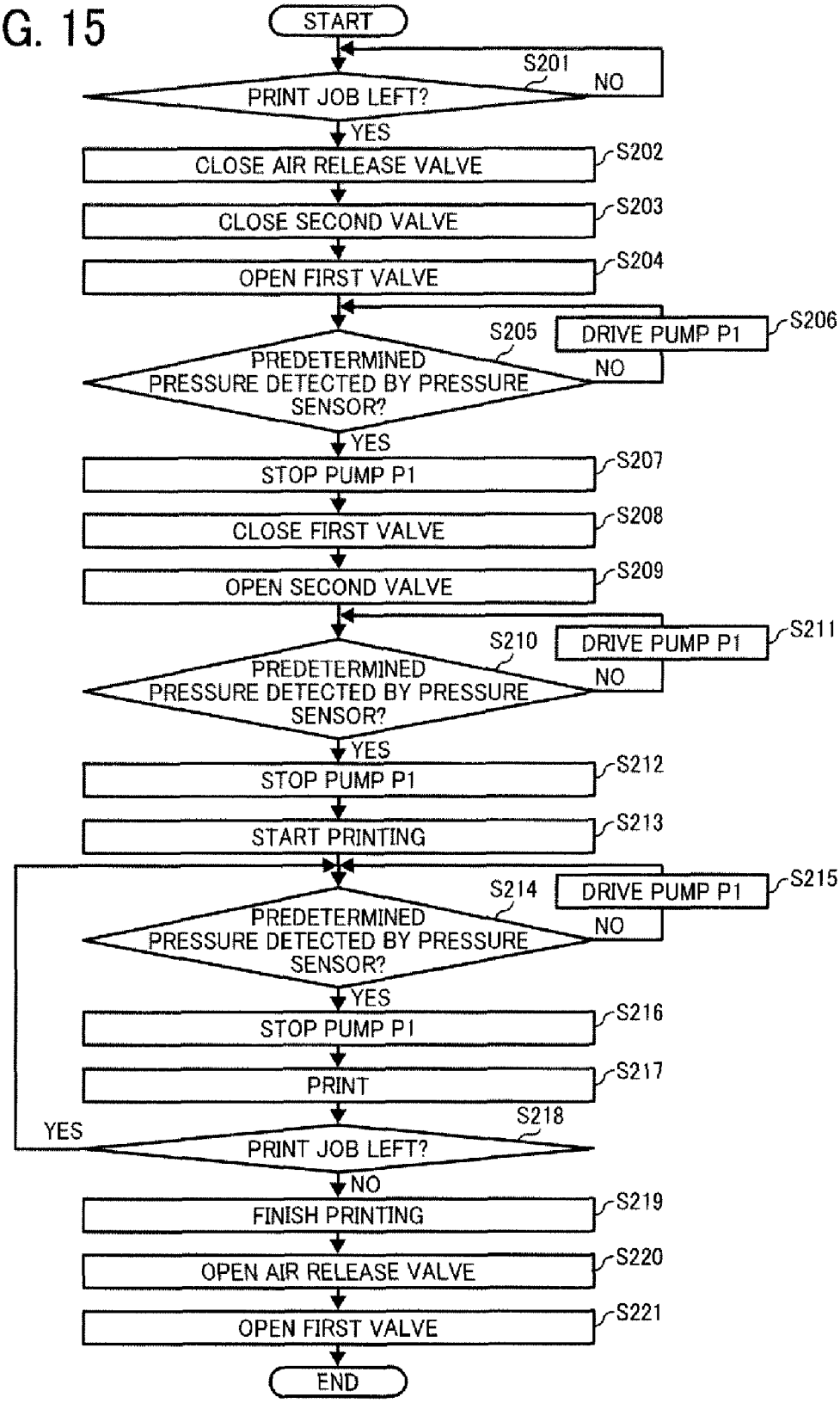
FIG. 15 is a flow chart illustrating steps in a process of supplying ink from the ink cartridge.

Next, ink supply operation of the ink cartridge 70 is described with reference to FIGS. 13 and 15.

When the inkjet printer is stopped or waiting for a print signal, the pressure pump 65 is stopped and the air release valve 67 and the valves 68 and 69 are opened. Accordingly, air-tube passages 81 and 82, the first deformation portion 79, and the second deformation portion 80 are communicated with the atmosphere. When the inkjet printer receives a print job ("YES" at S201), the air release valve 67 and the second valve 69 are closed to separate the air-tube passages 81 and 82, the first deformation portion 79, and the second deformation portion 80 from the atmosphere (at S202, S203, and S204).

At S205, the pressure detected with the pressure sensor 66 is confirmed. At this time, first, the atmospheric pressure is detected. At S206, the pressure pump 65 is driven to put air from the exterior to the first deformation portion 79 through the first air-tube passage 81. Accordingly, the first deformation portion 79 inflates from the state indicated by a dotted line to the state indicated by a solid line illustrated in FIG. 13 and increases the internal pressure. When the pressure sensor 66 detects that the internal pressure reaches a predetermined target pressure value ("YES" at S205), at S207 the pressure pump 65 is stopped and at S208 the first valve 68 is closed. At S209, the second valve 69 is opened and the pressure pump 65 is driven to pressurize the second deformation portion 80 until the pressure sensor 66 detects a predetermined pressure value (S210 and S211). With such operations, ink in the ink pack 74 is pressurized into a proper pressure ("YES" at S210).

At this state, the pressure pump 65 is stopped at S212 and print operation is started at S213. Ink to be ejected from the recording head 1 is supplied from the head tank 11 illustrated in FIG. 12. As the amount of ink decreases in the ink chamber 16 of the head tank 11, the negative-pressure valve 15 opens as illustrated in FIG. 3C, causing the ink chamber 16 to be communicated with the pressurized chamber 12. As illustrated in FIG. 12, ink in the pressurized chamber 12 is communicated with the ink pack 74 pressurized, and accordingly ink is promptly replenished from the ink cartridge 70 to the head tank 11. As the internal pressure of the ink chamber 16 exceeds a predetermined pressure by the replenishment of ink, the negative-pressure valve 15 is closed as illustrated in FIG. 3B, thus causing the ink chamber 16 to be hermetically sealed. Thus, printing is performed while alternately repeating the states illustrated in FIGS. 3B and 3C to maintain the internal pressure of the ink chamber 16 substantially constant. At this time, ink in the ink cartridge 70 is pressurized with a predetermined pressure. Accordingly, even when ink consumption speed by the recording head 1 is fast or the ink supply passage has a high fluid resistance due to use of a long tube, such a configuration allows stable ink supply while preventing ink supply shortage.

As the amount of ink in the ink pack 74 decreases by printing, the pressure applied to ink decreases. For the ink cartridge 70 illustrated in FIG. 13, contraction of the ink pack 74 reduces the pushing force of the ink pack 74 against the first deformation portion 79. Thus, the reduction in the ink pressure can be detected with the pressure sensor 66. If the pressure sensor 66 detects that the ink pressure is below a desired pressure ("NO" at S214), at S215 the pressure pump 65 is driven to pump air into the second deformation portion 80 via the air passage 64. As a result, the second deformation portion 80 is inflated to press the pressure plate 75, thus applying pressure on the ink pack 74. Accordingly, the pressure value of ink in the ink pack 74 returns to its original pressure value ("YES" at S214). Such returning to the original pressure value of ink can be detected with the pressure sensor 66, and accordingly at the time of detection, at S216 the pressure pump 65 is stopped.

Thus, while maintaining the pressure of ink in the ink pack 74 in a certain range of pressure values, the second deformation portion 58 is inflated to supply ink to the recording head 1, allowing sequential printing to be performed (S217).

When no print job remains ("NO" at S218) and printing is finished (S219), the air-release valve 67 is opened at S220 to release the pressed state of the ink pack 74 by the second deformation portion 80. At S221, the first valve 68 is opened, and accordingly the first deformation portion 79 is opened to the atmosphere to release the pressurized state. Thus, the pressurized state of ink in the ink pack 74 and the pressurized chamber 12 of the head tank 11 is released, thus preventing ink from slowly leaking even if the sealing performance of the negative-pressure valve 15 of the head tank 11 is insufficient. Further, for example, when the ink cartridge 70 is removed from the cartridge holder 31, the above-described configuration can securely prevent ink from leaking from the connection portion between the ink cartridge 70 and the cartridge holder 31.

Figure 16A:
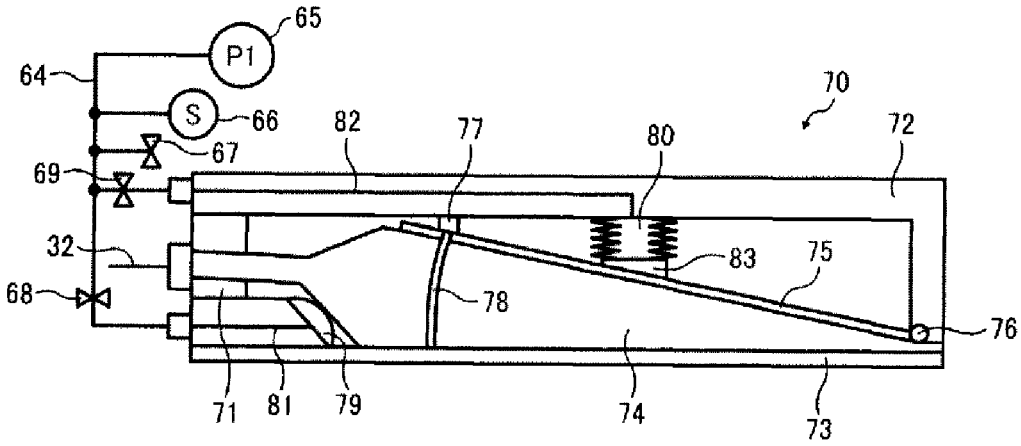
FIG. 16A is a cross-sectional view illustrating a state in which ink of the ink cartridge is not in use.
Figure 16B:
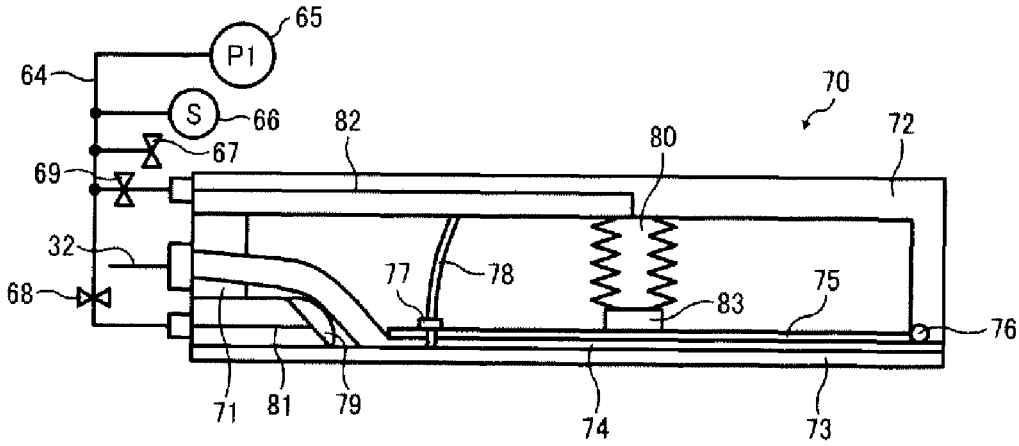
FIG. 16B is a cross-sectional view illustrating a state in which the ink cartridge is out of ink.

FIG. 16A is a cross-sectional view illustrating a state in which ink of the ink cartridge 70 is not in use. FIG. 16B is a cross-sectional view illustrating a state in which the ink cartridge 70 is out of ink.

In the ink cartridge 70 according to the present exemplary embodiment, as ink is consumed by printing, the ink pack 74 is compressed by the pressure plate 75 and flattened as illustrated in FIG. 7 when the ink pack 74 is out of ink. At this state, even if air is pumped into the second deformation portion 80 with the pressure pump 65, the second deformation portion 80 is not inflated and consequently the first deformation portion 79 is not pressed by the ink pack 74. As a result, the internal pressure of the first deformation portion 79 monitored with the pressure sensor 66 does not return from a reduced state due to ink consumption to a proper range, thus allowing the pressure sensor 66 to detect that the ink pack 74 is out of ink.

In the ink cartridge 70 according to the present example embodiment, the pressure plate 75 compresses the ink pack 74 while pushing ink toward the spout 71, preventing an extra amount of ink from being left in the ink pack 74 at the ink end state. By releasing the pressure of the first deformation portion 79 after releasing the pressure of the second deformation portion 80, the pressure of the ink pack 74 is securely released, preventing ink from leaking when the ink cartridge 70 is removed.

As described above, in the present exemplary embodiment, the ink cartridge that supplies ink by applying pressure on the ink pack is provided with a mechanism of compressing the ink pack in one direction from one end of the ink pack and two types of pressure sources to apply pressure on the ink pack. Such a configuration allows ink to be supplied at high speed in printing, securely prevents ink from leaking in non-driving period, and reduces the amount of residual ink remaining in the ink pack at the ink-end state. Further, with such a configuration, pressure is applied on the ink pack by using the pressure of fluid, allowing ink to be pressed in a simple configuration.

A third exemplary embodiment of the present disclosure is described with reference to drawings.

Figure 17:
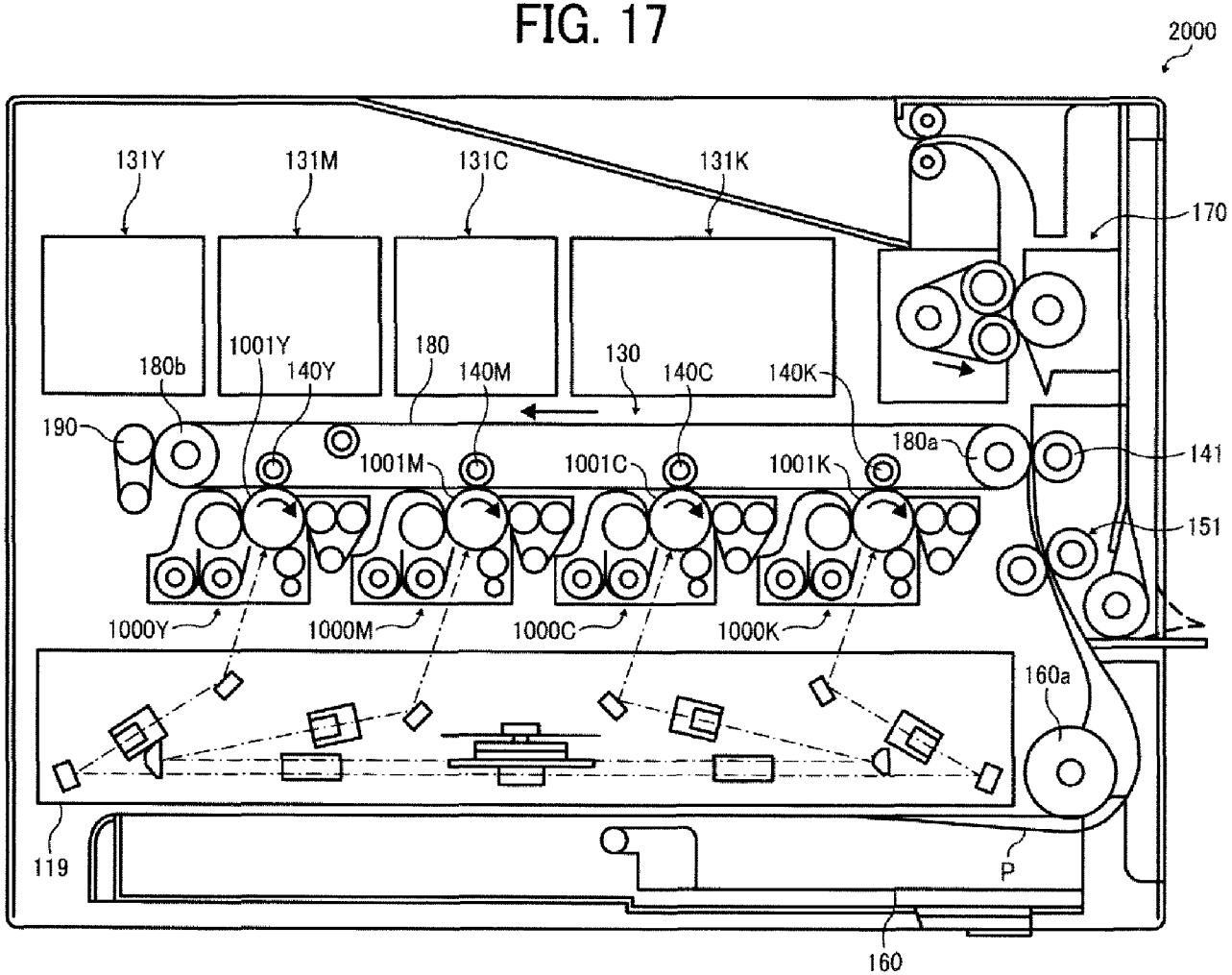
FIG. 17 is a schematic view illustrating a configuration of an image forming apparatus according to a third exemplary embodiment.
Figure 18A:
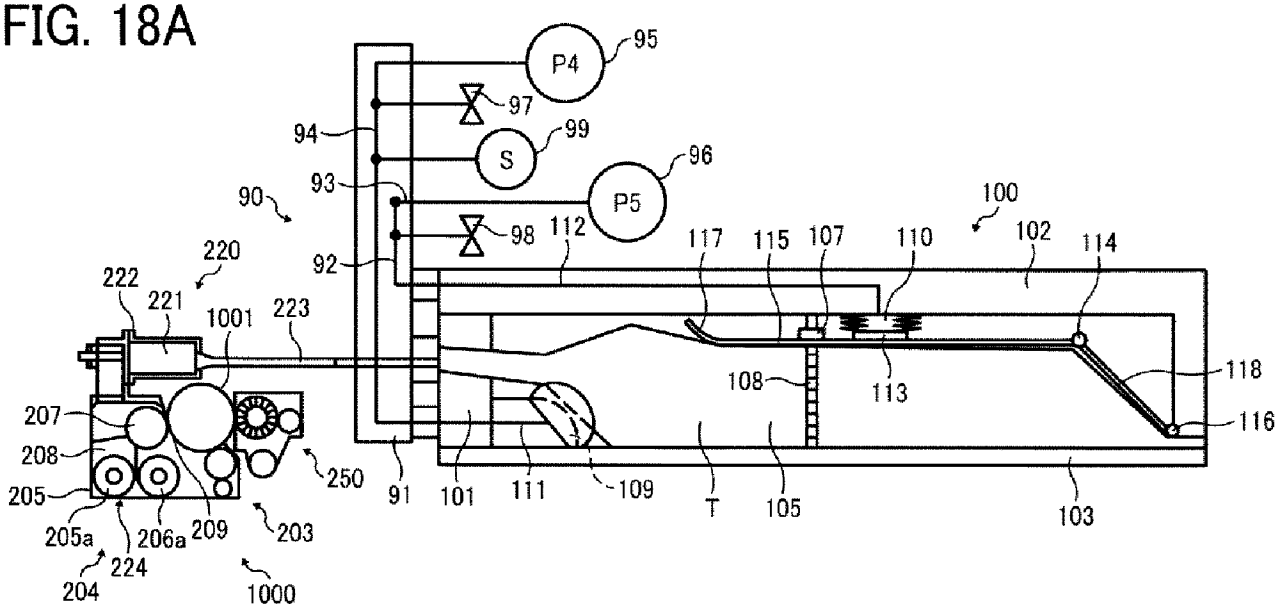
FIGS. 18A and 18B are schematic views illustrating a configuration of a toner supply device usable in the image forming apparatus.
Figure 18B:
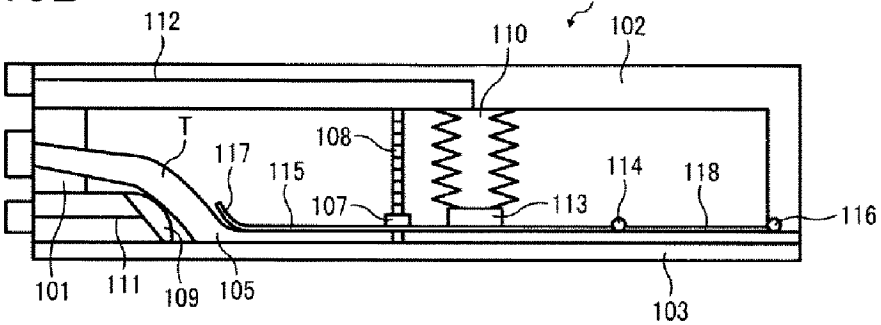

FIGS. 17 and 18A and 18B are schematic views illustrating a configuration of an the image forming apparatus 2000 according to the third exemplary embodiment. In FIGS. 17 and 18A and 18B, the image forming apparatus 2000 is illustrated as an apparatus (printer) that forms images according to an electrophotographic method.

At an upper portion of the image forming apparatus 2000 is disposed a toner-container accommodating portion in which toner containers 131Y, 131M, 131C, and 131K corresponding to different color inks (yellow, magenta, cyan, and black) are removably (replaceably) mounted. At a lower portion of the toner-container accommodating portion, imaging units 1000Y, 1000M, 1000C, and 1000K of the respective colors are disposed opposing an intermediate transfer unit 130.

For example, the imaging unit 1000Y of yellow includes a photosensitive drum 1001Y surrounded by a charging unit, a development device (development unit), a cleaning unit, and a discharging unit not illustrated. Imaging processes including charging, exposure, development, transfer, and cleaning are performed to form an image of yellow on the photosensitive drum 1001Y. The other three imaging units 1000M, 1000C, and 1000K have a substantially same configuration as that of the imaging unit 1000Y and forms images of the respective toner colors. In the description below, the color codes Y, M, C, and K are omitted unless specifically needed.

The photosensitive drum 1001 is rotated by a driving motor, not illustrated, in a clockwise direction illustrated in FIG. 17. The surface of the photosensitive drum 1001 is evenly charged at the charging unit (charging process). The exposing unit emits a laser beam onto the surface of the photosensitive drum 1001 to form an electrostatic latent image of each color (exposure process). The electrostatic latent image on the surface of the photosensitive drum 1001 is developed at a position opposing the development device to form a toner image of each color (development process). At a position at which the intermediate transfer belt 180 opposes a primary-transfer bias roller 140, the toner image on the photosensitive drum 1001 is transferred onto the intermediate transfer belt 180 (primary transfer process).

At this time, a slight amount of non-transferred toner remains on the photosensitive drum 1001 and is mechanically recovered by a cleaning blade at a position opposing the cleaning unit (cleaning process). Residual potential remaining in the photosensitive drum 1001 is removed at a position opposing the discharge unit, not illustrated, and a series of imaging processes performed on the photosensitive drum 1001 ends.

The above-described imaging processes are similarly performed in each of the imaging units 1000Y, 1000M, 1000C, and 1000K. Resultant toner images of the respective colors on the photosensitive drum 1001 are superposed on the intermediate transfer belt 180 to form a composite color image.

The intermediate transfer unit 130 includes the intermediate transfer belt 180, the primary-transfer bias rollers 140, a secondary-transfer backup roller 180*a*, a cleaning backup roller, a tension roller 180*b*, and an intermediate-transfer cleaning unit 190. The intermediate transfer belt 180 is supported with tension by both the secondary-transfer backup roller 180*a* and the tension roller 180*b*, and circulated by rotation of one of the rollers 180*a* and 180*b* in a direction indicated by an arrow illustrated in FIG. 17.

Each of the four primary-transfer bias rollers 140Y, 140M, 140 C, and 140K sandwiches the intermediate transfer belt 180 between the corresponding photosensitive drum 1001 and it to from a primary-transfer nipping portion. A transfer bias of a polarity opposite a polarity of toner is applied to the primary-transfer bias roller 140. The intermediate transfer belt 180 travels in the direction indicated by the arrow illustrated in FIG. 17 and serially passes the primary-transfer nipping portions of the primary-transfer bias rollers 140. The toner images of the different colors are primarily transferred one on another on the intermediate transfer belt 180.

The secondary-transfer backup roller 180*a* sandwiches the intermediate transfer belt 180 between a secondary transfer roller 141 and it to form a secondary-transfer nipping portion. The composite-color toner image on the intermediate transfer belt 180 is transferred on a transfer material P, such as a transfer sheet, conveyed at the secondary-transfer nipping portion.

At this time, residual toner having not been transferred onto the transfer material P remains on the intermediate transfer belt 180. Hence, such residual toner on the intermediate transfer belt 180 is recovered at the intermediate-transfer cleaning unit 190, and a series of transfer processes performed on the intermediate transfer belt 180 ends.

The transfer material P is conveyed from a tray 160 disposed at a lower portion of the image forming apparatus 2000 to the secondary-transfer nipping portion via a sheet-feed roller 160*a*, a pair of registration rollers 151, and so forth. The tray 160 stores a plurality of transfer materials P, and the sheet-feed roller 160*a* is rotated counterclockwise to feed a topmost one of the transfer materials P between the pair of registration rollers 151.

When conveyed to the pair of registration rollers 151, the transfer material P is stopped at a roller nipping portion of the pair of registration rollers 151 halted. Then, the pair of registration rollers 151 is rotated at a timing suitable for the color toner image on the intermediate transfer belt 180 to feed the transfer material P to the secondary-transfer nipping portion.

The transfer material P on which the color image has been transferred at the secondary-transfer nipping portion is conveyed to a fixing unit 170. The fixing unit 170 fixes the color image on the surface of the transfer material P by applying heat and pressure with, e.g., a fixing roller and a pressure roller. The transfer material P is output to the exterior via a pair of output rollers and stacked. Thus, a series of image forming processes of the image forming apparatus is finished.

FIGS. 18A and 18B are schematic views illustrating a configuration of the imaging unit employing a toner supply device 90.

As with a common electrophotographic process, a charging device 203 evenly supplies electric charges to the photosensitive drum 1001, and the exposure device emits a light beam in accordance with a desired image to form an electrostatic latent image on the photosensitive drum 1001. A development device 204 develops the electrostatic latent image with toner to form a toner image. A cleaning device 250 recovers residual toner on the photosensitive drum 1001 and transports the recovered toner to a recovery bottle.

In the image forming apparatus, the toner image on the photosensitive drum 1001 is transferred by a transfer device (or via the intermediate transfer belt) onto a transfer sheet fed by a sheet feed device. The toner image is fixed on the transfer sheet by the fixing device and outputted to the exterior of the image forming apparatus.

A toner container 205 has a front cross-section of a substantially square or rectangular shape and has a shape of extending in the long direction. The development device 204 is connected to the toner supply device 90 that replenishes toner consumed by image formation.

The development device 204 is a so-called two-component development device and stores developer 208 containing toner particles and carriers therein. The developer 208 is agitated by transport screws 205*a* and 206*a*. A development roller 207 is provided with magnets of a plurality of polarities fixed therein and a rotatable sleeve at an outer periphery. While retaining the agitated developer 208 on the sleeve by the magnets, the development roller 207 develops a latent image to form a toner image. A doctor blade 209 regulates the developer 208 on the development roller at a certain height.

In the development device 204, toner is consumed with image formation. The development device 204 includes a toner concentration sensor 224 that continuously detects the toner concentration of the developer 208. When the toner concentration of the developer 208 falls below a predetermined concentration, the development device 204 is controlled to transmit an operation signal to the toner supply device 90.

The toner supply device 90 supplies toner to the development device 204. A toner container 100 includes a spout 101 of a rigid body, a case member 102, a cover member 103, and a toner storage member 105 formed of a flexible bag in the cover member 103. The toner storage member 105 is formed of a single- or multi-layer flexible sheet having a thickness of approximately 50 to 200 μm of paper or resin such as polyethylene or nylon. The toner storage member 105 stores unused toner "T" therein, and when the toner is used up, the toner container 100 is replaced with a new one. One end portion of the toner storage member 105 is fixed at the spout 101, and the toner storage member 105 is fixedly accommodated via the spout 101 in the toner container 100 formed of the case member 102 and the cover member 103. A pressure plate 115 is disposed in contact with a surface of the toner storage member 105 and forms a link mechanism together with an intermediate shaft 114 and a pivot plate 118 that pivots around a pivot shaft 116 at the bottom side of the case member 102 (opposite the spout 101). As illustrated in FIG. 18A, at an initial (unused) state, the pressure plate 115 is oriented parallel to a primary surface of the case member 102 of the toner storage member 105. Such a configuration effectively uses the internal space of the toner container 100 to achieve a great capacity of toner container, thus reducing the frequency of replacing the toner container.

An end portion 117 of the pressure plate 115 is bent toward a side opposite a side contacting the toner storage member 105. As illustrated in FIG. 18B, such a configuration prevents the toner storage member 105 from being damaged by the end portion of the pressure plate 115 at a toner near-end state. Alternatively, the end portion 117 and/or the surface of the toner storage member 105 contacting the end portion 117 may be covered with a protective member such as a film.

The pressure plate 115 is also provided with a second deformation portion 110 via a pressing member 113 at the side opposite the toner storage member 105. The second deformation portion 110 is inflated and extended by air supplied from a pressure pump 96 of a printer side. As a result, the pressure plate 115 compresses the toner storage member 105 to deliver toner "T" with pressure.

The pressure plate 115 is also provided with a beam holder 107. The beam holder 107 is disposed on the pressure plate 115 so as to be slidable in a direction parallel to the primary surface of the pressure plate 115 and moves while being guided by a guide member 108 of the case member 102. An engaging portion between the beam holder 107 and the guide member 108 has a configuration similar to the configuration illustrated in FIG. 14 and therefore descriptions thereof are omitted. As described above, as the pressure plate 115 has the beam holder 107 and the guide member 108, the pressure plate 115 is movable in a direction to compress the toner storage member 105.

Near the spout 101 is disposed a first deformation portion 109 that presses the toner storage member 105 without contacting the pressure plate 115. A portion of the first deformation portion 109 is fixed at the toner storage member 105. Such a configuration prevents the first deformation portion 109 from excessively contracting at a non-pressurized state, thus reducing the time from when air starts to flow into the first deformation portion 109 to when pressure starts to be applied on the toner storage member 105. As with the second deformation portion 110, the first deformation portion 109 is driven by a pressure pump 95 of the printer to extend and contract.

Figure 19:
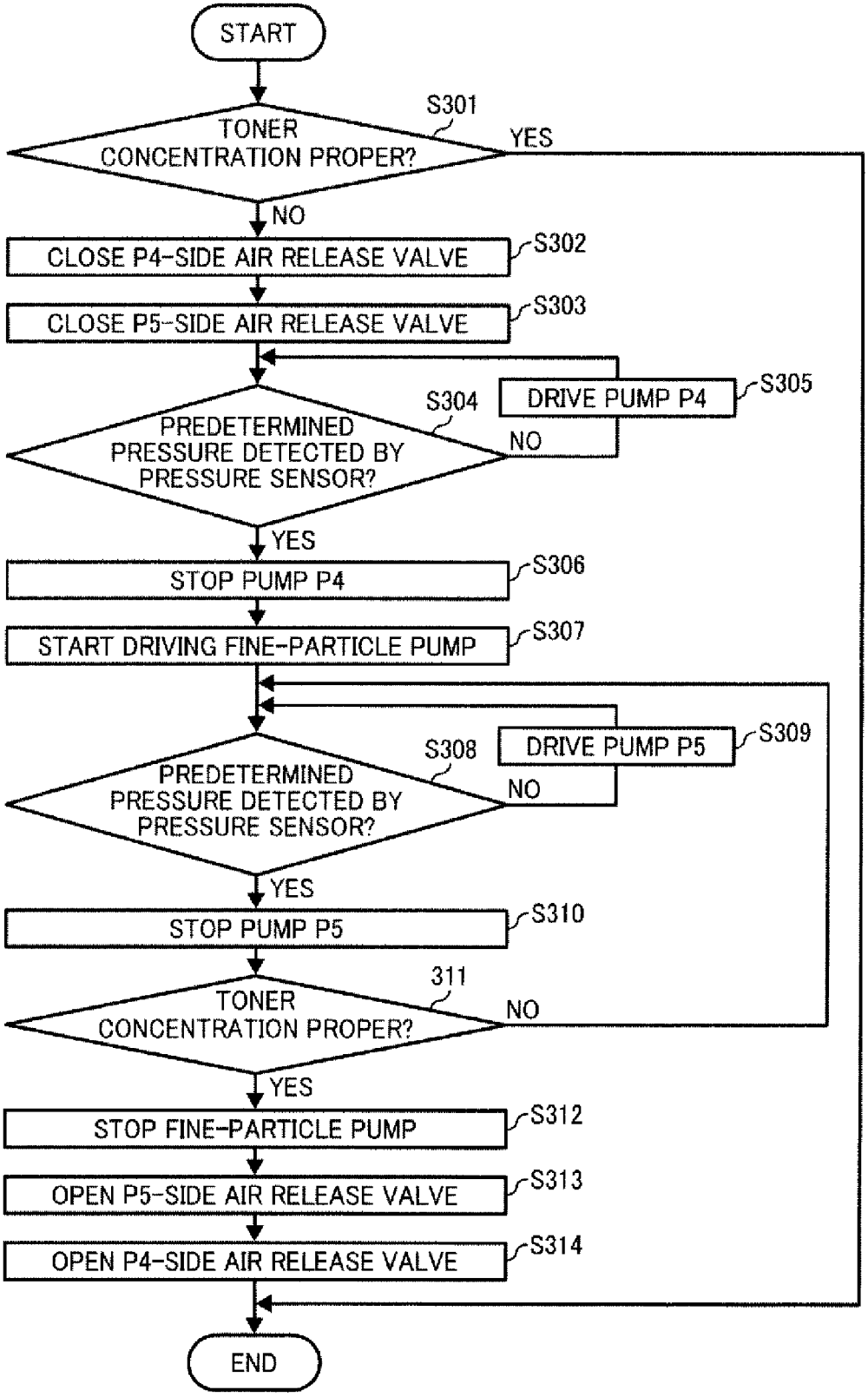
FIG. 19 is a flow chart illustrating steps in a process of outputting toner performed by the toner supply device.

Toner output operation of the toner supply device 90 is described with reference to FIG. 19.

If a toner supply signal is transmitted from the toner concentration sensor 224 of the development device 204 ("NO" at S301), at S302 and S303 a first air-release valve 97 and a second air-release valve 98 are closed to separate air passages 93 and 94, the first deformation portion 109, and the second deformation portion 110 from the atmosphere. Next, the pressure detected by a pressure sensor 99 is confirmed. At this time, first, the atmospheric pressure is detected ("NO" at S304). At S305, the first pressure pump 95 is driven to put air from the exterior into the first deformation portion 109 through a first air-tube passage 111. Thus, the first deformation portion 109 inflates from the state indicated by a dotted line to the state indicated by a solid line illustrated in FIG. 18A to increase the internal pressure. When the internal pressure reaches a predetermined target pressure ("YES" at S304), at S306 the first pump 95 is stopped.

When a fine-particle pump 220 is activated to generate suction pressure, toner "T" around the spout 101 moves toward the left side of an output tube 223 in FIG. 18A and supplied to the development device 204 via the fine-particle pump 220 at S307.

The fine-particle pump 220 may be, e.g., a single-axis eccentric screw pump and includes a rotor 221 of a external thread made of a synthetic material of, e.g., metal and resin and a fixed stator 222 having an internal-thread hole made of elastic material such as robber or soft resin. The rotor 221 and the stator 222 are separated by a sealed space at a predetermined penetration amount. By rotating the rotor 221, the sealed space moves to generate suction pressure in the supply passage to transport toner "T".

As the amount of toner decreases in the toner storage member 105, the toner storage member 105 contracts, and as a result, the pushing force of the toner storage member 105 against the first deformation portion 109 decreases, thus reducing the pressure of the first deformation portion 109. Such a change in the pressure can be detected with the pressure sensor 99. If the pressure detected by the pressure sensor 99 falls below a predetermined pressure ("NO" at S308), at S309 the second pump 96 is driven to pump air into the second deformation portion 110 via a second air passage 112. Accordingly, the second deformation portion 110 inflates to press the pressure plate 115, thus pressing the toner storage member 105. As a result, the pressure amount of the toner storage member 105 returns to its original level ("YES" at S308). Such returning of the pressure to its original level can be detected with the pressure sensor 99, and at the time of detection, the second pump 96 is stopped (S310).

Thus, while maintaining the pressurized force of the toner storage member 105 in a certain range, the toner storage member 105 is compressed to supply ink to the development device 204. When toner is sufficiently replenished in the development device 204 by the toner supply device 90 and such sufficiently-replenished state is detected by the toner concentration sensor 224 ("YES" at S311), the fine-particle pump 220 is stopped at S312, and at S313 the second air-release valve 9B is opened to release the pressed state of the toner storage member 105 by the second deformation portion 110. At S314, the first air-release valve 97 is opened and accordingly the first deformation portion 109 is opened to the atmosphere, thus releasing the pressurized state of the first deformation portion 109. Accordingly, the pressed state of the toner storage member 105 is securely released, thus preventing ink from leaking from a connecting portion between the toner container 100 and a mount portion of the image forming apparatus when the toner container 100 is removed from the mount portion of the image forming apparatus.

Further, a shutter may be provided at the connecting portion between the toner container 100 and the mount portion of the image forming apparatus to prevent toner from blowing out even if residual pressure remains in the toner container 100. In such a case, for the configuration in which the pressure sensor 99 is connected to the air passage 94, controlling air pressure from the first deformation portion 109 to the first pump 95 may be obviated.

FIG. 18B is a schematic cross-sectional view illustrating a state in which the toner container 100 is out of ink.

In the toner container 100, as toner is consumed by toner replenishment to the development device 204 of the image forming apparatus, the toner storage member 105 is compressed by the pressure plate 115 and flattened when toner is lost as illustrated in FIG. 18B. At this state, even if the second pump 96 pumps air into the second deformation portion 110, the second deformation portion 110 is not inflated and the first deformation portion 109 is not pressed via the toner storage member 105. Accordingly, the pressure in the first deformation portion 109 monitored by the pressure sensor 99 does not return from a reduced state due to toner consumption to a proper range, thus allowing the pressure sensor 99 to detect that the toner storage member 105 is out of toner.

A detector that detects a distance between the cover member 103 and one of the pressure plate 115 and the pivot plate 118 may be disposed at a proper position of the cover member 103, the pressure plate 115, or the pivot plate 118, allowing the amount of residual toner to be precisely detected. In such a case, the detector may have a simple configuration such as a pair of spring electrodes. A fully flattened state (toner-end state) of the toner storage member 105 and a substantially flattened state (near-end state) are detectable depending on the setting of such spring electrodes. For example, the plurality of spring electrodes having different heights may be disposed on the cover member 103 at the forward direction of the pressure plate 115, allowing detection of the compressed state of the toner storage member 105 at multi levels. The near end state and the toner end state may be separately detected by the detector and the pressure sensor 99, respectively. Detecting the near end state allows a user to be precisely notified in advance of the need for toner replacement, thus improving usability of the image forming apparatus.

The toner supply device 90 securely compresses the toner storage member 105 while pushing toner toward the spout 101 by the pressure plate 115, thus preventing toner from being wastefully left over at the toner end state of the toner container 100. After the release of the pressure of the second deformation portion 110, the pressure of the first deformation portion 109 is released to slightly expand the volume of the toner storage member 105. Accordingly, the positive pressure in the toner container 100 is securely released, preventing toner from being scattered when the toner container 100 is removed from the mount portion of the image forming apparatus.

The above-described exemplary embodiments are examples of embodiments and are not intended to limit the cope of the present invention.

For example, in the above-described description, the ink cartridge that supplies ink to the recording head is described as a liquid container according to an exemplary embodiment. However, it is to be noted that the liquid container may be implemented as a liquid cartridge that supplies liquid to a liquid ejection device for ejecting liquid other than liquid, such as DNA sample, resist material, or patterning material.

As described above, numerous additional modifications and variations are possible in light of the above teachings.

Next, an imaging-material container according to a fourth exemplary embodiment is described with reference to FIGS. 20 and 21.

Figure 20:
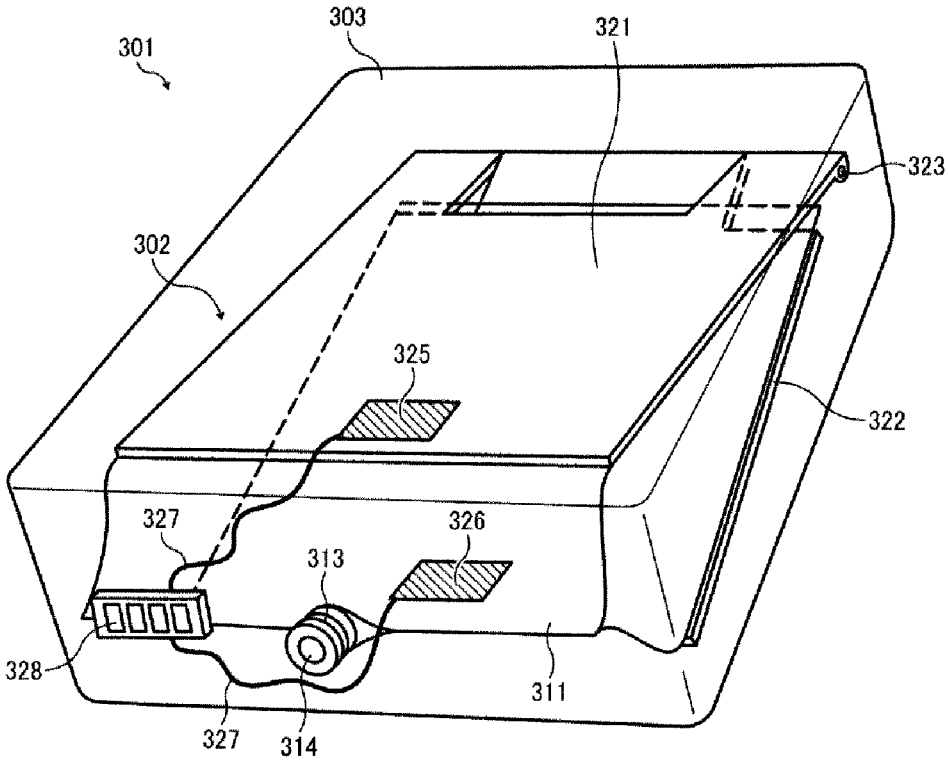
FIG. 20 is a perspective view illustrating a configuration of an imaging-material container according to a fourth exemplary embodiment.

FIG. 20 is a perspective view illustrating a configuration of an ink cartridge 301 as the imaging-material container. FIG. 21 is a cross-sectional view illustrating the ink cartridge 301.

In the ink cartridge 301, an ink pack 302 is accommodated in a cartridge case 303 serving as an outer case member, which is transparently illustrated in FIG. 20.

An ink bag 311 of the ink pack 302 is an imaging-material storage member and a deformable member of a bag shape made of flexible sheet material such as polyethylene, nylon, or PET (polyethylene terephthalate). The ink bag 311 is filled with ink 310. A supply port member 313 is an imaging-material supply port that receives an imaging-material introduction member, e.g., a hollow nozzle member of the image forming apparatus and is fixed in the ink bag 311 by heat welding. In the supply port member 313 is provided an elastic member, e.g., a rubber seal member 314 that prevents ink from leaking from the interior of the ink bag 311 when the ink cartridge 301 is mounted in, installed into, removed from, and separated from the image forming apparatus. The supply port member 313 of the ink bag 311 is mounted on a side wall of the cartridge case 303.

A first plate 321 and a second plate 322 serving as a plate member are attached on outer surfaces of opposing side walls of the ink bag 311 by, e.g., heat welding, adhesive agent, or dual-faced adhesive tape. The first plate 321 and the second plate 322 swings (or pivots) around a support shaft 323 so as to be foldable at the back of an edge portion 302*a* of the ink bag 311 opposite the supply port member 313.

The edge portion 302*a* of the support-axis (back) side of the first plate 321 and the second plate 322 has an edge line formed by folding or bonding the side faces of the ink bag 311. Thus, when ink 310 is suctioned from the ink bag 311 to reduce the pressure in the ink bag 311, such a configuration allows the ink bag 311 to contract in a certain orientation, thus reducing the amount of unused ink remaining in the ink bag 311.

The first plate 321 and the second plate 322 are provided with a first electrode plate 325 and a second electrode plate 326, respectively, and connected from the first electrode plate 325 and the second electrode plate 326 to a board 328 via lead wires 327. Both the board 328 and the image forming apparatus are conducted to a detection electrode, not illustrated, of the image forming apparatus via, e.g., a spring contact.

In the image forming apparatus, the capacitance between the first electrode plate 325 and the second electrode plate 326 is detected. When the detected capacitance reaches a predetermined value, a control unit causes a display unit or a host machine to notify a user of an ink-end or ink-near-end state.

Figure 21:
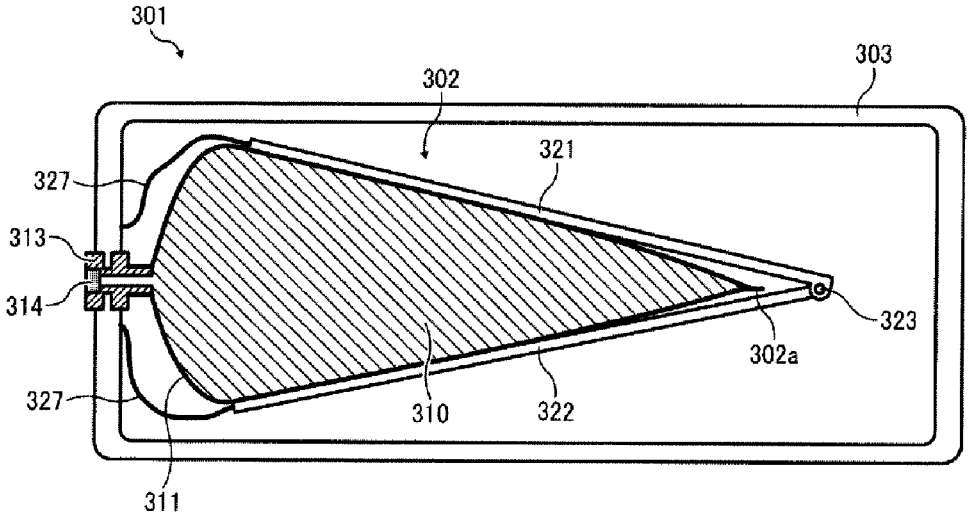
FIG. 21 is a cross-sectional view illustrating the imaging-material container.

In the ink cartridge 301 mounted in the image forming apparatus, as ink 310 is consumed in the ink bag 311, the internal pressure of the ink bag 311 decreases and as a result, the ink bag 311 contracts from a full state illustrated in FIG. 21 to a state illustrated in FIG. 3A or 3B.

Figure 22A:
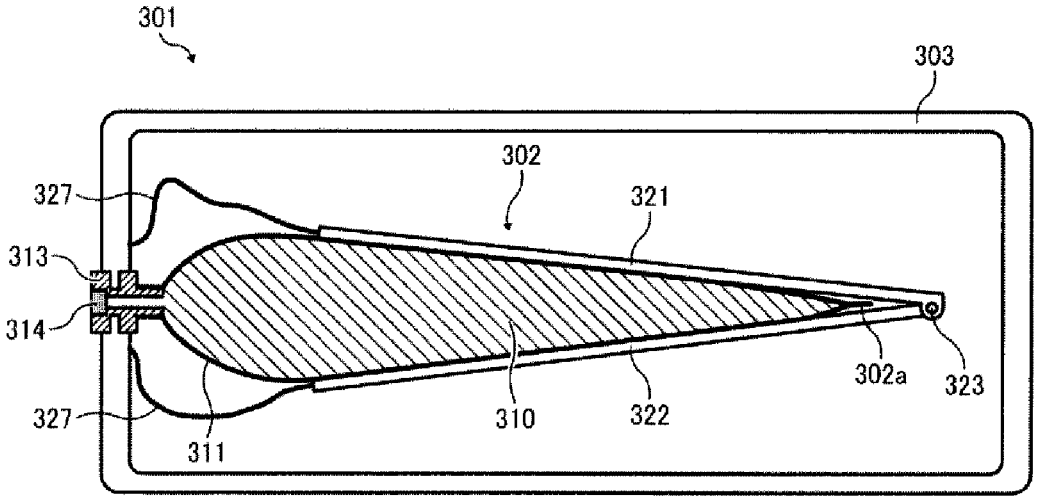
FIGS. 22A and 22B are cross-sectional views illustrating the imaging-material container.
Figure 22B:
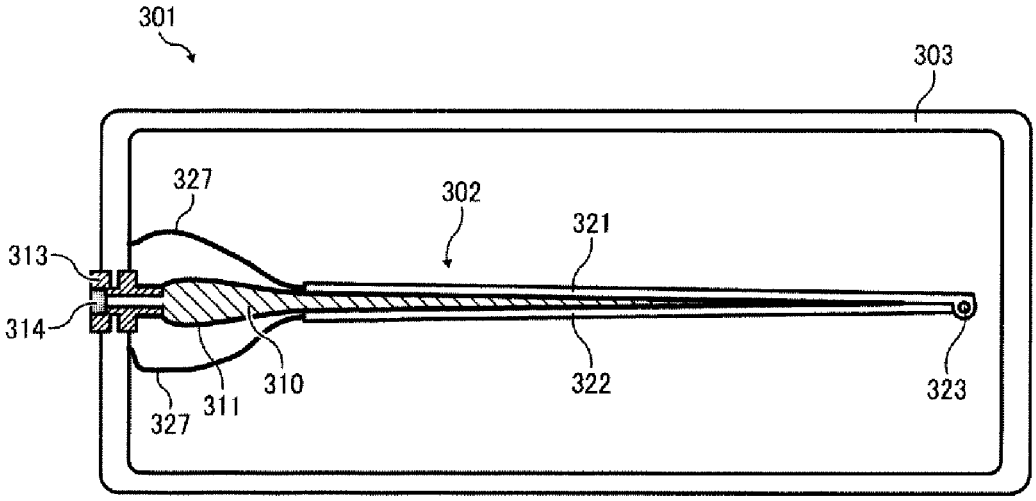

At this time, the first plate 321 and the second plate 322 on the opposing sidewall surfaces of the ink bag 311 pivot around the support shaft 323 at the side opposite of the supply port member 313. Thus, as illustrated in FIGS. 22A and 22B, the first plate 321 and the second plate 322 regulates the ink bag 311 with pressure so that the volume of the back side of the supply port member 313 is constantly smaller than the volume of the front side close to the supply port member 313.

Thus, in the ink bag 311, ink effectively moves from the back side to the supply port side, thus reducing the amount of unused ink remaining in the ink bag 311.

A change in the distance between the first plate 321 and the second plate 322 causes a change in the capacitance between the first electrode plate 325 and the second electrode plate 326, resulting in a change in the resistance relative to a certain voltage applied. Thus, in the image forming apparatus, such a change in the resistance is detected to determine the amount of ink remaining in the ink bag 311, thus allowing detection of the ink-end or ink-near-end state.

As described above, the ink cartridge according to the present exemplary embodiment includes the imaging-material storage member of a deformable bag shape having at least two opposing sidewalls, the imaging-material supply member that receives an imaging-material introduction member of the image forming apparatus, and the plate members mounted on outer surfaces of the respective sidewalls of the imaging-material storage member. The plate members are foldable around an end portion opposite the imaging-material supply member. Such a configuration allows the configuration of the imaging-material container to be simplified, thereby reducing the cost. Further, such a configuration can reduce the amount of imaging material remaining unused in the imaging-material storage member while stably supplying the imaging material.

Figure 23:
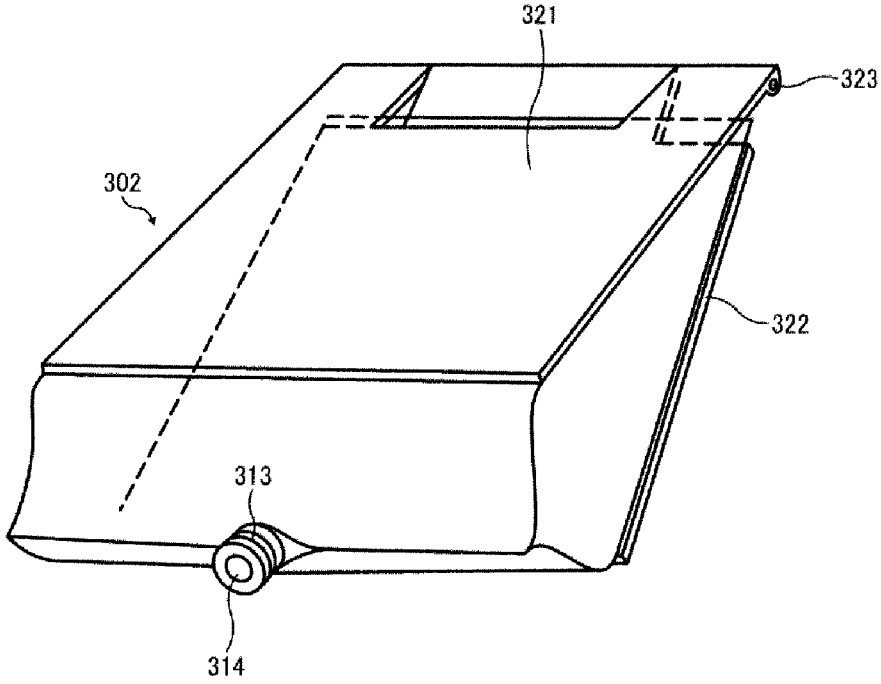
FIG. 23 is a cross-sectional view illustrating an imaging-material container according to a fifth exemplary embodiment.

Next, an imaging-material container according to a fifth exemplary embodiment is described with reference to FIG. 23.

In this exemplary embodiment, the ink pack 302 according to the fourth exemplary embodiment itself is used as an imaging-material container (ink cartridge) without being accommodated in the cartridge case 303. The configuration of the ink pack 302 is similar to the configuration of the fourth exemplary embodiment and therefore a description thereof is omitted.

Next, an imaging-material container according to a sixth exemplary embodiment is described with reference to FIGS. 24, 25A, and 25B.

In this exemplary embodiment, one of the first plate 321 and the second plate 322 according to the fourth exemplary embodiment is formed of a wall portion 331 of the cartridge case 303. In FIGS. 24, 25A, and 25B, the first plate 321 is pivotably supported with a support shaft 323 that is disposed on the wall portion 331.

Figure 24:
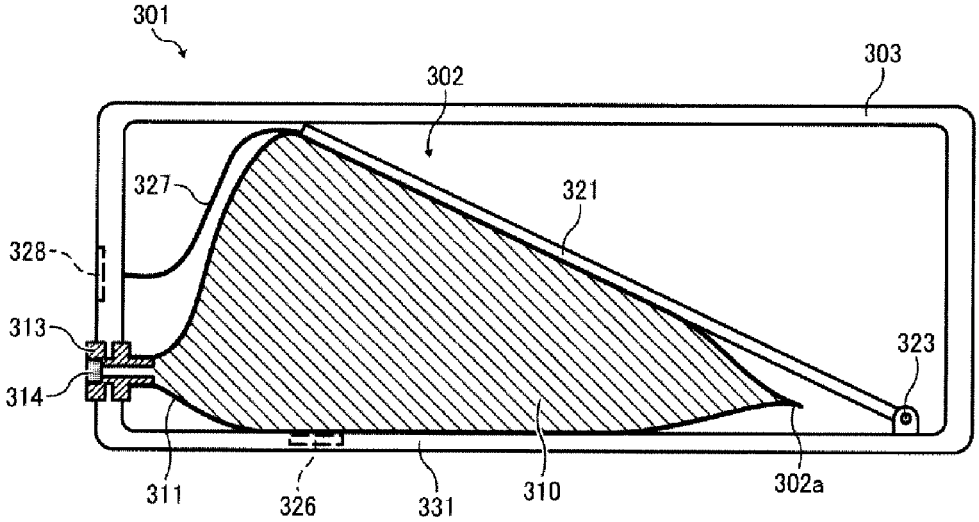
FIG. 24 is a cross-sectional view illustrating an imaging-material container according to a sixth exemplary embodiment.
Figure 25A:
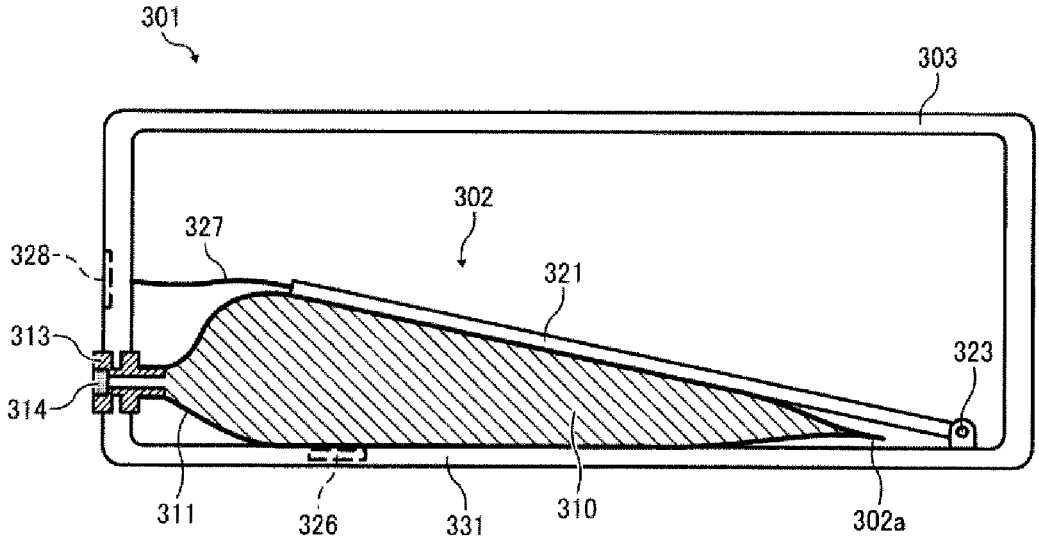
FIG. 25 is cross-sectional views illustrating the imaging-material container.
Figure 25B:
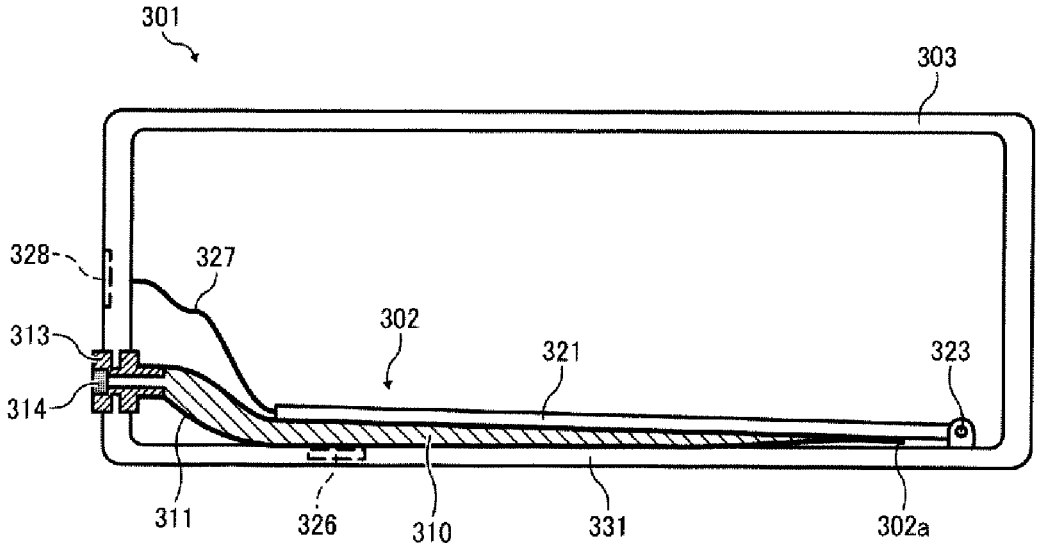

In this case, as ink is consumed in the ink bag 311, the first plate 321 pivots around the support shaft 323 from a full state illustrated in FIG. 24 to a state illustrated in FIG. 25A or 25B so as to approach to the wall portion 331 of the cartridge case 303. Accordingly, the effect similar to the fourth exemplary embodiment can be obtained, and use of only the first plate 321 results in a simple configuration.

Figure 26:
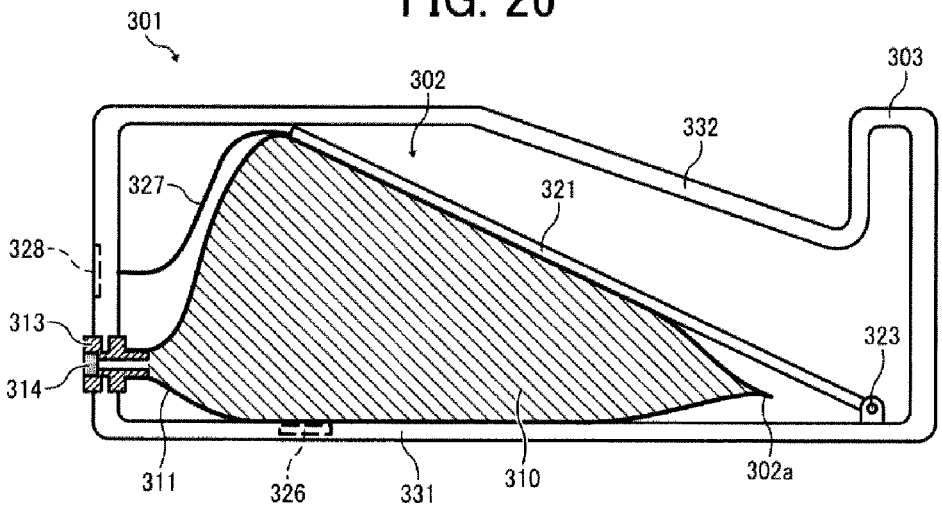
FIG. 26 is a cross-sectional view illustrating an imaging-material container according to a seventh exemplary embodiment.

Next, an imaging-material container according to a seventh exemplary embodiment is described with reference to FIG. 26.

In the above-described sixth exemplary embodiment, a recess portion 332 is formed at a portion of the cartridge case 303 corresponding to a space formed by disposing the first plate 321 at a slant in the cartridge case 303. A user can install and remove the ink cartridge 301 into and from the image forming apparatus while hooking his/her finger to the recess portion 332, thus improving operability.

An image forming apparatus according to an exemplary embodiment that employs the imaging-material container is described with reference to FIGS. 27 and 29.

Figure 27:
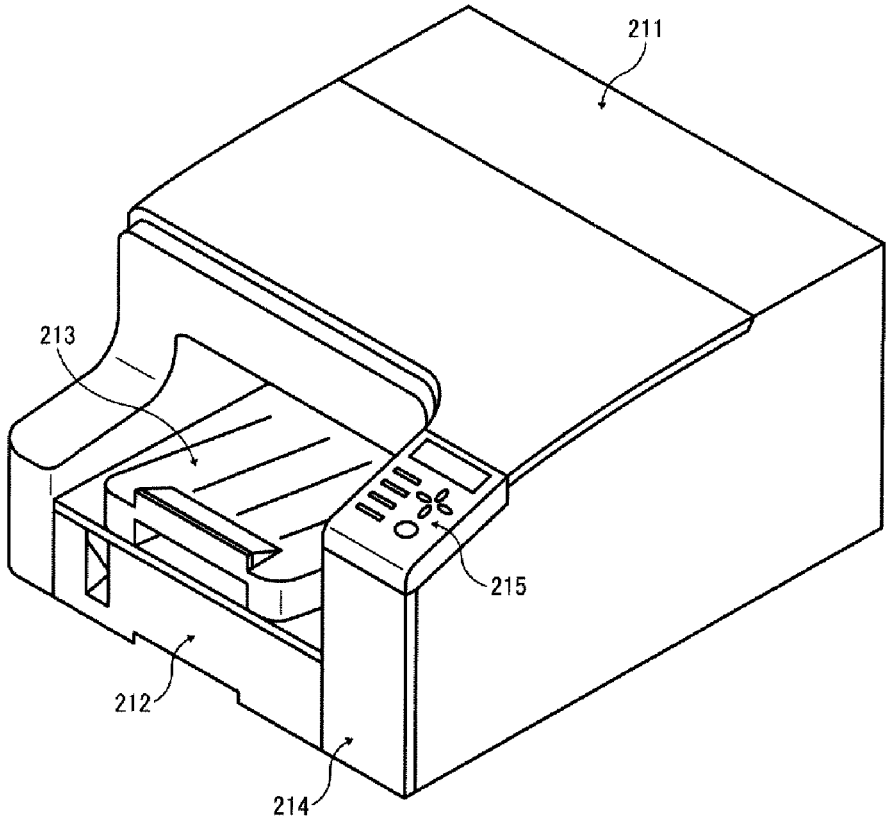
FIG. 27 is a cross-sectional view illustrating an image forming apparatus employing an imaging-material container according to an exemplary embodiment.
Figure 28:
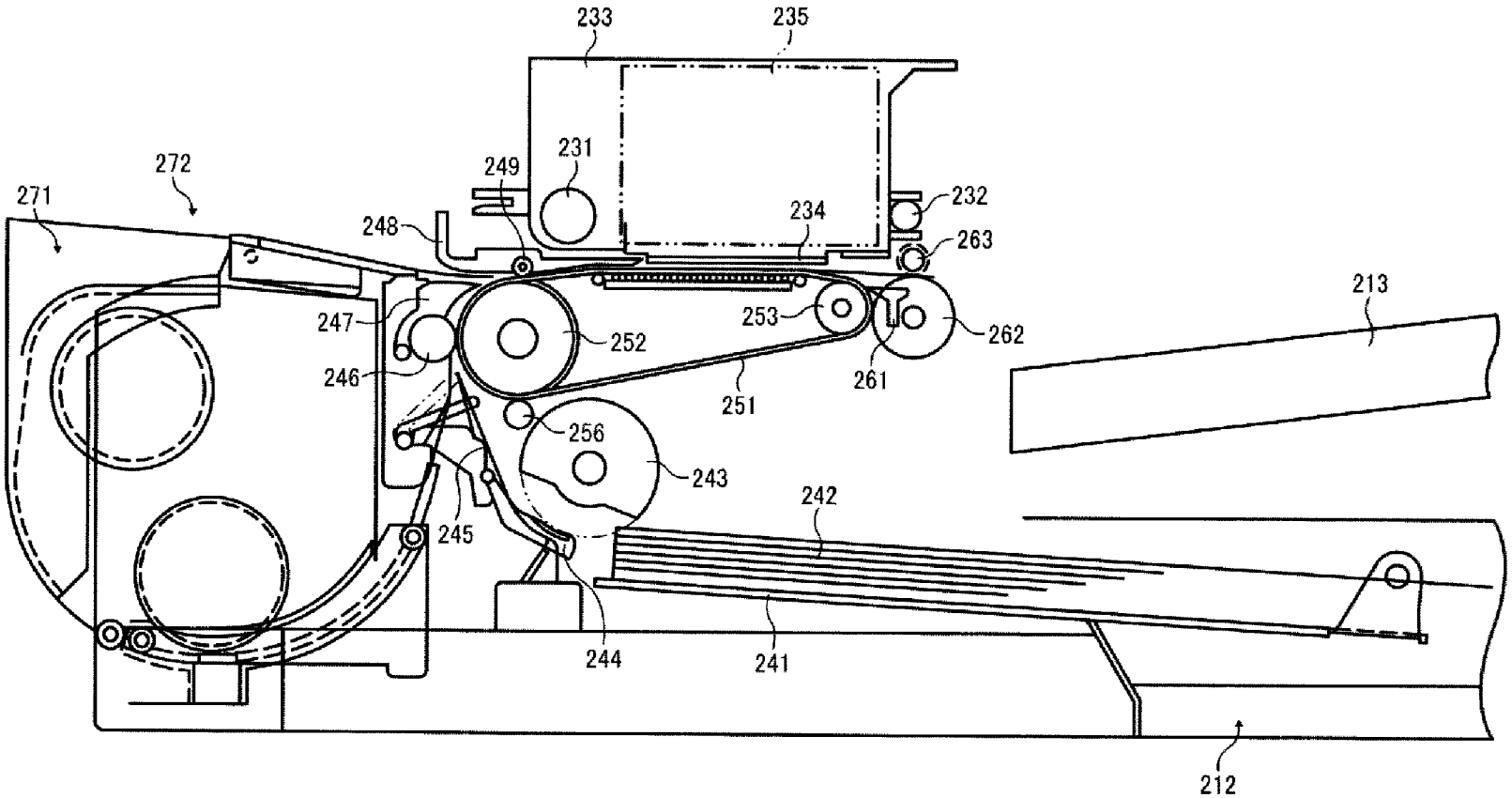
FIG. 28 is a schematic side view illustrating a mechanical section of the image forming apparatus.

FIG. 27 is an external perspective view illustrating an image forming apparatus according to the present exemplary embodiment. FIG. 28 is a schematic side view illustrating a mechanical section of the image forming apparatus. FIG. 29 is a partial plan view illustrating the mechanical section illustrated in FIG. 28.

Figure 29:
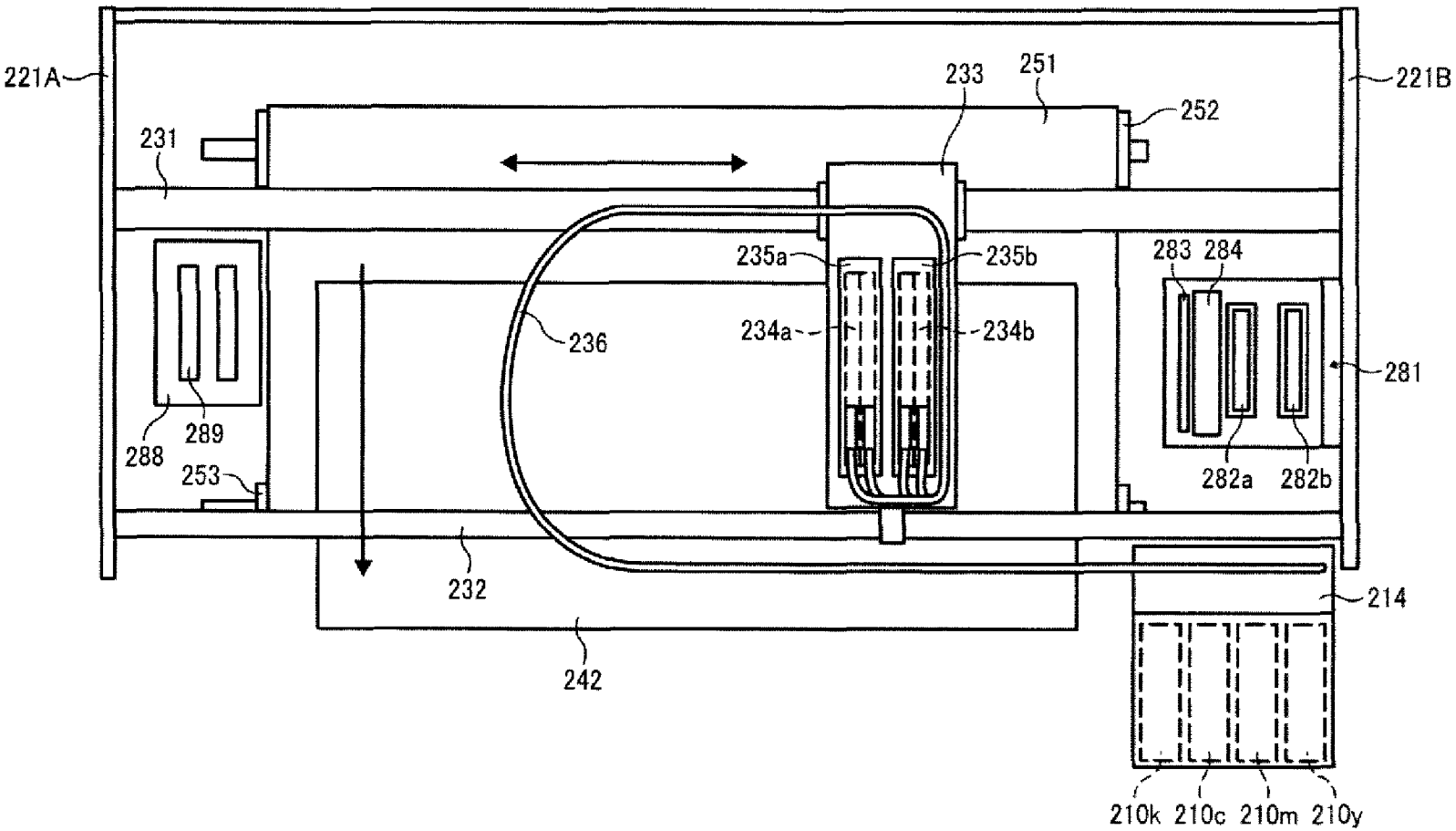
FIG. 29 is a schematic plan view illustrating the mechanical section of the image forming apparatus.

In FIGS. 27 to 29, the image forming apparatus is illustrated as a serial-type inkjet recording apparatus. The image forming apparatus includes a housing 211, a sheet feed tray 212, and a sheet output tray 213. The sheet feed tray 212 is mounted in the housing 211 so as to be extractable to a sheet refill position and stores sheets to be fed to a print section of the image forming apparatus. The sheet output tray 213 receives a sheet outputted after image recording (formation). The sheet output tray 213 is pivotably mounted on the housing so as to open and close an upper portion of the sheet feed tray 212, thus acting as a cover member of the sheet feed tray 212. Further, at one end portion of the front side of the housing 211 is disposed a cartridge mount portion 214 in which an ink cartridge(s) serving as the imaging-material container according to the present exemplary embodiment is(are) mounted. At the top face of the cartridge mount portion 214 is mounted an operation-and-display unit 215 including operation buttons and a display.

In the image forming apparatus, both a main guide rod 231 and a sub guide rod 232 extend between side plates 221A and 221B to support a carriage 233 slidable in a main scan direction "MSD" indicated by a double arrow illustrated in FIG. 29. The carriage 233 moves for scanning by a main scan motor, not illustrated, via a timing belt.

On the carriage 233 are mounted recording heads 234*a* and 234*b* (hereinafter, collectively referred to as "recording heads 234" unless colors are distinguished) to eject ink droplets of different colors, e.g., yellow (Y), cyan (C), magenta (M), and black (K). In the recording heads 234 serving as liquid ejection heads, a plurality of nozzle rows consisting of nozzles is arranged in a sub-scan direction perpendicular to the main scan direction so as to eject ink droplets downward.

Each of the recording heads 234 may include two nozzle rows. For example, the recording head 234*a* may eject black ink droplets from one nozzle row and cyan ink droplets from the other nozzle row, and the recording head 234*b* may eject magenta ink droplets from one nozzle row and yellow ink droplets from the other nozzle row.

On the carriage 233 are mounted head tanks 235*a* and 235*b* (hereinafter collectively referred to as "head tanks 235" unless colors are distinguished) serving as secondary imaging-material containers that supply color inks corresponding to the respective nozzle rows of the recording heads 234. The head tanks 235*a* and 235*b* may be formed with the carriage 233 as a single integrated unit. From the ink cartridges 210 which are the main imaging-material containers according to any one of the above-described exemplary embodiments, color inks are supplied to the head tanks 235 via supply tubes 236.

The image forming apparatus further includes a sheet feed section that feeds sheets 242 stacked on a sheet stack portion (platen) 241 of the sheet feed tray 212. The sheet feed section further includes a sheet feed roller 243 that separates the sheets 242 from the sheet stack portion 241 and feeds the sheets 242 sheet by sheet and a separation pad 244 that is disposed opposing the sheet feed roller 243. The separation pad 244 is made of a material of a high friction coefficient and biased toward the sheet feed roller 243.

To feed the sheet 242 from the sheet feed section to a portion below the recording heads 234, the image forming apparatus includes a first guide member 245 that guides the sheet 242, a counter roller 246, a conveyance guide member 247, a press member 248 including a front-end press roller 249, and a conveyance belt 251 that conveys the sheet 242 to a position facing the recording heads 234 with the sheet 242 electrostatically attracted thereon.

The conveyance belt 251 is an endless belt that is looped between a conveyance roller 252 and a tension roller 253 so as to circulate in a belt conveyance direction "BCD", that is, the sub-scan direction. A charge roller 256 is provided to charge the surface of the conveyance belt 251. The charge roller 256 is disposed to contact the surface of the conveyance belt 251 and rotate depending on the circulation of the conveyance belt 251. By rotating the conveyance roller 252 by a sub-scan motor, not illustrated, via a timing roller, the conveyance belt 251 circulates in the belt conveyance direction "BCD" illustrated in FIG. 29.

The image forming apparatus further includes a sheet output section that outputs the sheet 242 on which an image has been formed by the recording heads 234. The sheet output section includes a separation claw 261 that separates the sheet 242 from the conveyance belt 251, a first output roller 262, a second output roller 263, and the sheet output tray 213 disposed below the first output roller 262.

A duplex unit 271 is removably mounted on a rear portion of the image forming apparatus. When the conveyance belt 251 rotates in reverse to return the sheet 242, the duplex unit 271 receives the sheet 242 and turns the sheet 242 upside down to feed the sheet 242 between the counter roller 246 and the conveyance belt 251. At the top face of the duplex unit 271 is formed a manual-feed tray 272.

In FIG. 29, a maintenance unit 281 is disposed at a non-print area on one end in the main-scan direction of the carriage 233. The maintenance unit 281 including a recovery device maintains and recovers nozzles of the recording heads 234. The maintenance unit 281 includes caps 282*a* and 282*b* (hereinafter collectively referred to as "caps 282" unless distinguished) that cover the nozzle faces of the recording heads 234, a wiping blade 283 that is a blade member to wipe the nozzle faces of the recording heads 234, and a first droplet receiver 284 that receives ink droplets during maintenance ejection performed to discharge increased-viscosity ink.

In FIG. 29, a second droplet receiver 288 is disposed at a non-print area on the other end in the main-scan direction of the carriage 233. The second droplet receiver 288 receives ink droplets that are ejected to discharge increased-viscosity ink in recording (image forming) operation and so forth. The second droplet receiver 288 has openings 289 arranged in parallel with the rows of nozzles of the recording heads 234.

In the image forming apparatus having the above-described configuration, the sheet 242 is separated sheet by sheet from the sheet feed tray 212, fed in a substantially vertically upward direction, guided along the first guide member 245, and conveyed with sandwiched between the conveyance belt 251 and the counter roller 246. Further, the front tip of the sheet 242 is guided with a conveyance guide 237 and pressed with the front-end press roller 249 against the conveyance belt 251 so that the traveling direction of the sheet 242 is turned substantially 90 angle degrees. The sheet 242 is attracted on the charged conveyance belt 251 and conveyed in the sub scanning direction by circulation of the conveyance belt 251.

By driving the recording heads 234 in response to image signals while moving the carriage 233, ink droplets are ejected on the sheet 242 stopped below the recording heads 234 to form one band of a desired image. Then, the sheet 242 is fed by a certain amount to prepare for recording another band of the image. Receiving a signal indicating that the image has been recorded or the rear end of the sheet 242 has arrived at the recording area, the recording heads 234 finishes the recording operation and outputs the sheet 242 to the sheet output tray 213.

In the image forming apparatus is removably mountable the imaging-material container described in the present disclosure, thus preventing wasteful ink consumption and reducing the running cost.

In the above-described exemplary embodiment, ink is described as an example of the imaging material. As described above, the imaging material may be developing agent or toner used in the image forming apparatus.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different exemplary embodiments may be combined with each other and/or substituted for each other within the scope of this disclosure and appended claims.

What is claimed is:

1. An imaging-material container that stores imaging material to be supplied to an image forming device, the imaging-material container comprising:

a flexible storage member that stores imaging material;

a pressure unit that applies pressure on the flexible storage member;

a regulation member that contacts the flexible storage member to deform the flexible storage member; and a pushing unit that moves the regulation member as the imaging material is consumed.

2. The imaging-material container according to claim 1, further comprising a detector that detects pressure inside the flexible storage member, wherein the pushing unit is controlled in accordance with detection results of the detector.

3. The imaging-material container according to claim 2, wherein the detector determines pressure in the flexible storage member by detecting a change in the pressure applied to the flexible storage member.

4. The imaging-material container according to claim 1, wherein the regulation member deforms the flexible storage member only to reduce a volume of the flexible storage member.

5. The imaging-material container according to claim 1, wherein at least one of the pressure unit and the pushing unit is driven by fluid pressure.

6. The imaging-material container according to claim 1, further comprising a position detector that detects a position of the regulation member, wherein the pushing unit is controlled in accordance with detection results of the position detector.

7. The imaging-material container according to claim 6, wherein the position detector detects a position of the regulation member until the volume of the flexible storage member becomes minimum.

8. An ink cartridge comprising the imaging-material container according to claim 1, wherein imaging material is ink.

9. An image forming apparatus comprising:

the ink cartridge according to claim 8, wherein, prior to image formation, the pressure unit is driven to press the flexible storage member, in image formation, the pushing unit is driven to press the regulation member against the flexible storage member, and after image formation, the pushing unit is stopped and the pressure unit is stopped.

10. An imaging-material container that stores imaging material to be supplied to an image forming device, the imaging-material container comprising:

a deformable storage member comprising at least two opposing sidewalls;

an imaging-material supply portion mounted in the storage member to receive an introduction member disposed in the image forming device;

a plurality of plate members mounted on outer surfaces of the at least two opposing sidewalls of the storage member;

a plurality of electrodes disposed on the at least two opposing sidewalls of the storage member; and a terminal electrically connected to the image forming apparatus, wherein the plurality of plate members is folded around an end portion of the plurality of plate members disposed opposite the imaging-material supply portion.

11. An imaging-material container according to claim 10, further comprising an outer case member that houses the storage member and the plurality of plate members.

12. The imaging-material container according to claim 10, wherein the imaging material is ink or toner.

13. An image forming apparatus comprising the imaging-material container according to claim 10.

14. An imaging-material container that stores imaging material to be supplied to an image forming device, the imaging-material container comprising:

a deformable storage member comprising at least two opposing sidewalls;

an imaging-material supply portion mounted in the storage member to receive an introduction member disposed in the image forming device;

a plate member mounted on an outer surface of one of the at least two opposing sidewalls of the storage member;

an outer case member that houses the storage member and the plate member;

a plurality of electrodes disposed on the at least two opposing sidewalls of the storage member; and a terminal electrically connected to the image forming apparatus, wherein the plate member is folded against an inner wall surface of the outer case member around an end portion of the plate member disposed opposite the imaging-material supply portion.

15. The imaging-material container according to claim 14, wherein the imaging material is ink or toner.

16. An image forming apparatus comprising the imaging-material container according to claim 14.

* * * * *